US008551678B2

(12) United States Patent
Tokutake

(10) Patent No.: US 8,551,678 B2
(45) **Date of Patent: *Oct. 8, 2013**

(54) ELECTROPHOTOGRAPHIC PHOTORECEPTOR, IMAGE FORMING METHOD, IMAGE FORMING APPARATUS

(75) Inventor: Shigeaki Tokutake, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 224 days.

This patent is subject to a terminal disclaimer.

(21) Appl. No.: 12/989,403

(22) PCT Filed: Sep. 2, 2009

(86) PCT No.: PCT/JP2009/065310

§ 371 (c)(1),
(2), (4) Date: Oct. 22, 2010

(87) PCT Pub. No.: WO2010/029877

PCT Pub. Date: Mar. 18, 2010

(65) Prior Publication Data

US 2011/0033791 A1 Feb. 10, 2011

(30) Foreign Application Priority Data

Sep. 9, 2008 (JP) ..... 2008-230576

(51) Int. Cl.
*G03G 15/02* (2006.01)

(52) U.S. Cl.
USPC ..... 430/59.4; 430/58.05; 430/59.5; 430/60; 430/69

(58) Field of Classification Search
USPC ..... 430/58.05, 59.4, 59.5, 60, 69
See application file for complete search history.

(56) References Cited

U.S. PATENT DOCUMENTS

| | | | | |
|---|---|---|---|---|
| 7,358,018 | B2 * | 4/2008 | Taguchi | 430/69 |
| 2006/0188798 | A1 * | 8/2006 | Tokutake et al. | 430/60 |
| 2007/0054092 | A1 * | 3/2007 | Harada et al. | 428/141 |
| 2009/0280420 | A1 * | 11/2009 | Tokutake et al. | 430/66 |
| 2010/0104969 | A1 * | 4/2010 | Mochizuki et al. | 430/125.3 |

FOREIGN PATENT DOCUMENTS

| | | |
|---|---|---|
| JP | 07-199504 | 8/1995 |
| JP | 08-123058 | 5/1996 |
| JP | 2000-105479 | 4/2000 |
| JP | 2000-250239 | 9/2000 |
| JP | 2003-057926 | 2/2003 |
| JP | 2003-107757 | 4/2003 |

(Continued)

OTHER PUBLICATIONS

Notice of the Reasons of Rejection for JP Appl. No. 2010-528708, mailed Aug. 28, 2012, 5 pgs.

(Continued)

*Primary Examiner* — Mark F Huff
*Assistant Examiner* — Stewart Fraser
(74) *Attorney, Agent, or Firm* — Squire Sanders (US) LLP

(57) ABSTRACT

Disclosed is an electrophotographic photosensitive body which does not cause image defects such as black spots and image unevenness when image exposure is performed using light having a wavelength of 350-500 nm, which is so-called short-wavelength light. The electrophotographic photosensitive body is characterized by having at least an intermediate layer, a charge-generating layer containing a metal phthalocyanine pigment and a charge-transporting layer on a conductive supporting body which has a skewness of the profile (Rsk) within the range of $-8<Rsk<0$.

12 Claims, 4 Drawing Sheets

(56) References Cited

FOREIGN PATENT DOCUMENTS

| | | |
|---|---|---|
| JP | 2005-292363 | 10/2005 |
| JP | 2005-338446 | 12/2005 |
| JP | 2006-201686 | 8/2006 |
| JP | 2007-334342 | 12/2007 |

OTHER PUBLICATIONS

Translation of Notice of the Reasons of Rejection for JP Appl. No. 2010-528708, mailed Aug. 28, 2012, 7 pgs.

* cited by examiner

FIG. 6a Rsk>0
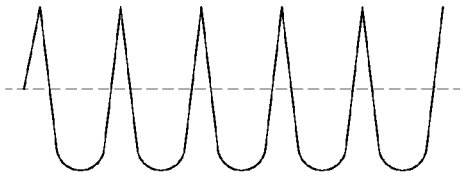
FIG. 6b Rsk<0
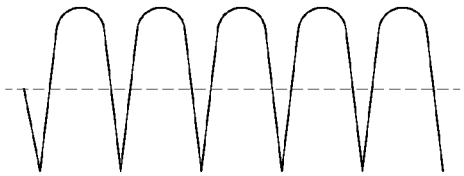
FIG. 7
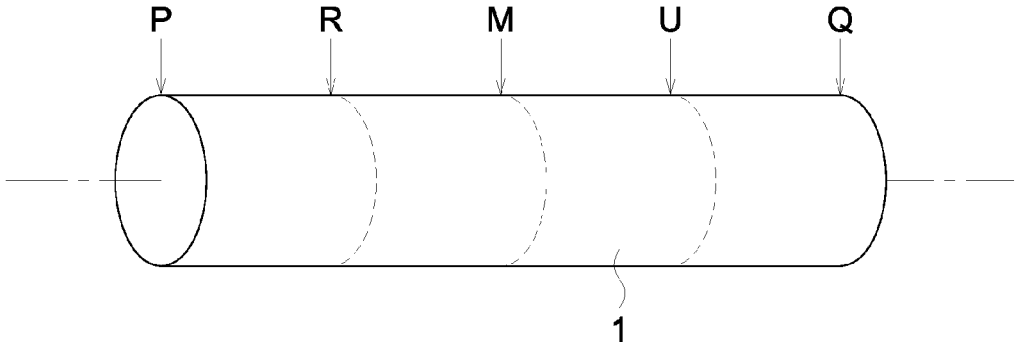

ELECTROPHOTOGRAPHIC PHOTORECEPTOR, IMAGE FORMING METHOD, IMAGE FORMING APPARATUS

This application is a U.S. National Phase Application under 35 USC 371 of International Application PCT/JP2009/065310, filed Sep. 2, 2009.

TECHNICAL FIELD

The present invention relates to an electrophotographic photoreceptor (hereafter, merely referred to as a photoreceptor) for use in an image formation with an electrophotographying system, and an image forming method and an image forming apparatus, which employs this electrophotographic photoreceptor.

BACKGROUND ART

In the field of image forming techniques with an electrophotographying system, in recent years, a digital image formation with high accuracy can be achieved by an exposure technique with a short wavelength laser beam having a wavelength of 350 to 500 nm and the like (for example, refer to Patent documents 1 and 2). As a result, in addition to the development of conventional copying machines and printers for office, it becomes possible to provide an image forming apparatus for the printing technical field where a high-quality image is required.

However, even if fine electrostatic latent images are formed on an electrophotographic photoreceptor by the irradiation of a microscopic exposure beam whose dot diameter is shortened with a short wavelength laser beam, it has not been realize yet to provide finally-acquired images with sufficiently-high image quality.

Namely, if image exposure is conducted with an exposure beam, whose dot diameter is shortened with a short wavelength laser beam, for an electrophotographic photoreceptor which has be developed for exposure beam with a conventional long wavelength, image defects, such as black spots and image unevenness, appear conspicuously on formed images. As a result, microscopic dot images cannot be reproduced accurately. Accordingly, when image formation is conducted with a short wavelength exposure beam for a conventional electrophotographic photoreceptor, since image defects tend to take place, there is a need to solve these problems.

REFERENCE DOCUMENT

Patent Document

Patent document No. 1: Japanese Unexamined Patent Publication No. 2000-250239 Official document Patent document No. 2: Japanese Unexamined Patent Publication No. 2000-105479 Official document

SUMMARY OF THE INVENTION

Problems to be Solved by the Invention

The present invention has been achieved in order to solve the abovementioned problems. That is, when image exposure is conducted by the use of an exposure beam with a wavelength of 350 nm to 500 nm (so-called "short wavelength exposure beam"), an object of the present invention is to provide an electrophotographic photoreceptor which does not cause image defects, such as black spots and image unevenness. Specifically, an object of the present invention is to provide an electrophotographic photoreceptor capable of forming halftone images exhibiting good dot reproducibility without image defects such as interference fringe and streaks-like unevenness when a short wavelength exposure beam is applied.

Means for Solving the Problems

As a result of repeated studies about the above problems, the present inventors conceived that a photosensitive layer is structured with a sufficient sensitivity for a short wavelength exposure beam of 350 to 500 nm and in addition, a structure is needed to prevent with high level charge injection from a conductive support to a photosensitive layer, and the present inventors found the present invention.

That is, the present invention can be attained by the electrophotographic photoreceptor having any one of structures described below.

1. An electrophotographic photoreceptor is characterized in that the electrophotographic photoreceptor comprises at least an intermediate layer, a charge generating layer and a charge transporting layer on a conductive support, the skewness (Rsk) of a profile curve of the conductive support is in a range of $-8<Rsk<0$, and the charge generating layer contains a metal phthalocyanine pigment.
2. The electrophotographic photoreceptor described in 1 is characterized in that the skewness (Rsk) of a profile curve of the conductive support is in a range of $-4<Rsk<-1$.
3. The electrophotographic photoreceptor described in 1 or 2 is characterized in that the metal phthalocyanine pigment is a gallium phthalocyanine pigment or a titanyl phthalocyanine pigment.
4. The electrophotographic photoreceptor described in any one of 1 to 3 is characterized in that the gallium phthalocyanine pigment is a hydroxy gallium phthalocyanine pigment which has a peak at least at 7.4° and 28.2° on a diffraction angle ($2\theta\pm0.2$) in the Cu-K$\alpha$ characteristic X ray diffraction.
5. The electrophotographic photoreceptor described in any one of 1 to 3 is characterized in that the gallium phthalocyanine pigment is a chloro gallium phthalocyanine pigment which has a peak at least at 7.4°, 16.6°, 25.5° and 28.3° on a diffraction angle ($2\theta\pm0.2$) in the Cu-K$\alpha$ characteristic X ray diffraction.
6. The electrophotographic photoreceptor described in any one of 1 to 3 is characterized in that the gallium phthalocyanine pigment is a gallium phthalocyanine pigment which has a peak at least at 6.8°, 12.8°, 15.8° and 26.6° on a diffraction angle ($2\theta\pm0.2$) in the Cu-K$\alpha$ characteristic X ray diffraction.
7. The electrophotographic photoreceptor described in any one of 1 to 3 is characterized in that the titanyl phthalocyanine pigment is a Y-type oxy titanyl phthalocyanine pigment which has a peak at least at 27.3° on a diffraction angle ($2\theta\pm0.2$) in the Cu-K$\alpha$ characteristic X ray diffraction.
8. The electrophotographic photoreceptor described in any one of 1 to 7 is characterized in that the intermediate layer contains N type semiconductive particles.
9. The electrophotographic photoreceptor described in 8 is characterized in that the N type semiconductive particles are titanium oxide or zinc oxide.
10. The electrophotographic photoreceptor described in 9 is characterized in that the titanium oxide is a rutile type titanium oxide or an anatase-type titanium oxide.

11. An image forming method is characterized by comprising:

a charging process to provide an charge potential at least on the electrophotographic photoreceptor described in any one of 1 to 10;

an exposing process to expose an exposure beam having a wavelength light of 350 nm or more and 500 nm or less onto the electrophotographic photoreceptor provided with the charge potential so as to form an electrostatic latent image;

a developing process to supply toner onto the electrophotographic photoreceptor so as to visualize the electrostatic latent image into a toner image; and a transferring process to transfer the above toner image formed on the abovementioned electrophotographic photoreceptor to a transfer medium.

12. The image forming method described in 11 is characterized in that a diameter of the exposure beam in the main scanning direction in an exposure beam source used in the exposing process is 10 μm or more and 50 μm or less.

13. An image forming apparatus is characterized by comprising:

the electrophotographic photoreceptor described in at least any one of 1 to 10;

a charging means for providing an charge potential on the electrophotographic photoreceptor; and an exposing means for exposing an exposure beam having a wavelength light of 350 nm or more and 500 nm or less onto the electrophotographic photoreceptor provided with the charge potential.

Effect of Invention

According to the present invention, when image exposure is conducted by the use of an exposure beam with a wavelength of 350 nm to 500 nm (so-called "short wavelength exposure beam"), it becomes possible to form dot images exhibiting high dense without image defects such black spots and image unevenness. Namely, when a short wavelength exposure beam is applied to the surface of an electrophotographic photoreceptor according to the present invention, it becomes possible to form halftone images exhibiting good dot reproducibility without image defects such as interference fringe and streaks-like unevenness. In this way, according to the present invention, it became possible to form stably a high quality electrophotographic image without image defects.

BRIEF DESCRIPTION OF THE DRAWINGS

FIG. 6 is a drawing for explaining a case where the skewness (Rsk) of a profile curve is positive and a case where the skewness (Rsk) of a profile curve is negative.

FIG. 7 is a drawing for explaining the positions where the skewness (Rsk) of a profile curve of a conductive substrate is measured.

EMBODIMENT FOR CARRYING OUT THE INVENTION

Figure 1:
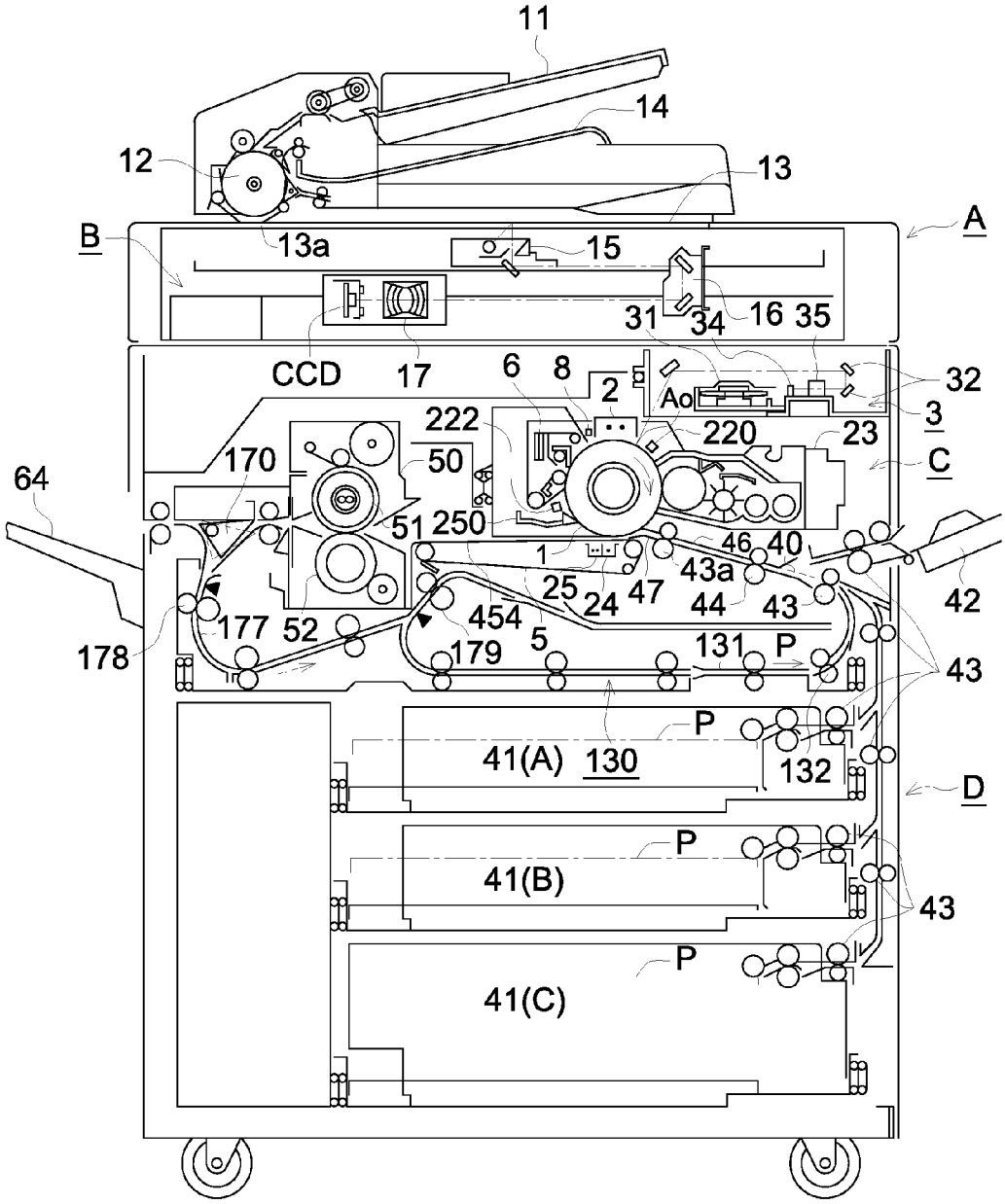
FIG. 1 is an outline view where the mechanism of an image forming apparatus of the present invention is incorporated.

Hereafter, the present invention will be explained in detail.

An electrophotographic photoreceptor according to the present invention comprises at least an intermediate layer, a charge generating layer and a charge transporting layer on a conductive support, the skewness (Rsk) of a profile curve of the conductive support is in a range of $-8<Rsk<0$, and the charge generating layer contains a metal phthalocyanine pigment.

Namely, the electrophotographic photoreceptor according to the present invention has a structure that the skewness (Rsk) of a profile curve of the conductive support becomes in the above range and the charge generating layer contains a metal phthalocyanine pigment. With the above structure, even if a minute dot exposure is performed by a short wavelength laser beam, an image without an inversion black spot and image unevenness can be acquired.

As a result, it becomes possible to form a latent image in which a minute dot diameter of exposure beam is made to reflect faithfully and dot reproducibility in high minute dot image formation can be improved. Further, when a halftone image is formed, the image quality of the halftone image can be improved without causing streaks-like density unevenness. In this way, the structure of the present invention makes it possible to provide an electrophotographic photoreceptor capable of forming an electrophotographic image with high quality.

First, the skewness of a profile curve of a surface of a conductive support which constitutes an electrophotographic photoreceptor (hereafter, simply referred to as a photoreceptor) according to the present invention will be explained. The term "skewness of a profile curve of a surface of a conductive support which constitutes a photoreceptor according to the present invention is one of parameters which specify the regularity of convexo-concave formed on the surface of the conductive support and specifies the degree of distortion (degree of warp) on the distribution state of mountain portions and valley portions which constitutes a roughness curve. Namely, in the case that a roughness curve of a surface of a conductive support is prepared and it is assumed that some variation exists on the distribution of mountain portions (convex portions) and valley portions (concave portions) constituting the roughness curve, the variation is quantified with a parameter named "the degree of distortion (degree of warp)" so as to specify the roughness of the surface of a conductive support.

In the present invention, the value of "skewness of a profile curve of a surface of a conductive support" is made larger than −8 and smaller than 0, preferably larger than −4 and smaller than −1. It may be considered that when the value of skewness is made within the abovementioned range, it becomes possible to solve the problems of leak discharging from a contact type electrically-charging member which is considered to be caused by existence of convex portions which exist on a surface of a conductive support. As a result, it may be considered that an exposure beam with a minute dot diameter by a short wavelength laser is reproduced faithfully on a photoreceptor, whereby dot reproducibility can be improved.

The skewness (Rsk) of a profile curve specified in the present invention is pursuant to the definition in "ISO 4287: 1997" and represented by the following formula:

$$Rsk = \frac{1}{Rq^3}\left(\frac{1}{I_r}\int_o^{l_r} Z^3(x)dx\right)$$

In the formula, R represents a root mean square roughness, Ir represents a length in the X-axis direction, and Z(x) represents the component, in the Z-axis (in the height (vertical) direction), of the roughness at a position of x. With the above formula, the term "skewness of a profile curve" is defined as a value obtained in such a way that the cube average of a parameter Z(x) representing the roughness in the height direction at a reference length is divided by the cube of a root mean square.

Further, the skewness (Rsk) of a profile curve of conductive support constituting a photoreceptor relating to the present invention is measured under the following conditions.

Measurement Conditions

Measurement device: Surface roughness meter (SURFCOM 1400D, manufactured by Tokyo Seimitsu Co., Ltd.)

Measured length (L): 8.0 mm

Cut-off wavelength (λc): 0.08 mm

Stylus tip configuration: Cone with a tip angle 60°

Stylus tip radius: 0.5 μm

Measurement rate: 0.3 mm/sec

Measurement magnification: 100,000 times

Measurement position: three positions at upper, intermediate and lower positions (three positions in total of a center and middle points between the center and end portions in the width direction on a photosensitive layer side surface of a conductive support)

The average value of the above three positions is made as a value of the skewness (Rsk) in the present invention.

FIG. 7 shows the measurement positions of a conductive support. In a conductive support 1 shown in FIG. 7, M represents a center in the width direction on a photosensitive layer side surface of the conductive support 1, and P and Q represent end portions on the photosensitive layer side surface of the conductive support 1 respectively. Then, R is a middle point between the center M and the end portion P, and U is a middle point between the center M and the end portion Q. Accordingly, the measurement positions of the skewness (Rsk) of the conductive support 1 shown in FIG. 7 are three points of the center M and the middle points R and U between the center M and the end portions P and Q.

Figure 4:
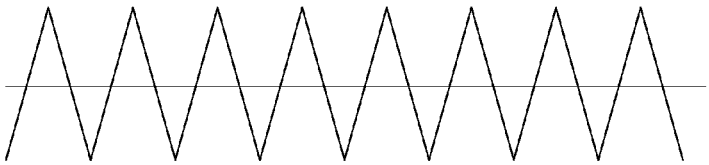
FIG. 4 is a drawing showing an example of a profile curve showing a regular convexo-concave configuration.
Figure 5:
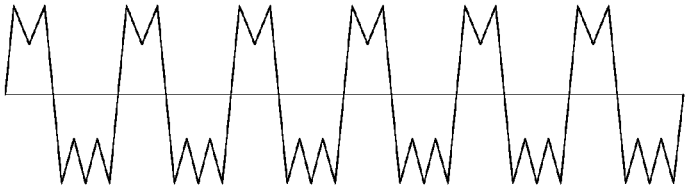
FIG. 5 is a drawing showing an example of a profile curve showing a regular convexo-concave configuration.

In this way, in the present invention, the inventor found that a regular convexo-concave configuration specified with the skewness in the above range is provide on a surface of a conductive support and the employment of the resultant conductive support having a such skewness can solve the problems of the present invention. Here, a regular convexo-concave configuration formed on a surface of a conductive support will be explained by the use of FIG. 4 and FIG. 5. The term "regular convexo-concave configuration formed in a surface of a conductive support" used in the present invention means that the sectional configuration of a conductive support has a repeated convexo-concave configuration with periodicity, for example, as shown in FIG. 4 or FIG. 5. For example, FIG. 4 shows a configuration in which convex portions (mountain) and concave portions (valley) with an acute angle are repeated regularly, and FIG. 5 shows a configuration in which repeated are convexo-concave patterns complicate more than that in FIG. 4. In FIG. 5, a small concave (valley) is provided at the tip part of a convex portion (mountain), and two small convex portions (mountain) are provided to a concave portion (valley). In the present invention, as long as the value of skewness is within the above range, the convexo-concave configuration includes all other configurations in addition to the convexo-concave patterns in the configuration explained in FIG. 4 or FIG. 5.

Further, the value of skewness (Rsk) of a profile curve of a conductive support is expressed with a sign of positive or negative, and then, a positive case and a negative case will be explained with reference to FIG. 6.

First, FIG. 6(*a*) shows a case that the skewness (Rsk) of a profile curve of a conductive support is positive, and the profile curve, indicated with a solid line, on the surface of the conductive support is structured with convex portions with a sharp acute angle and roundish concave portions. On the other hand, FIG. 6(*b*) shows a case that the skewness (Rsk) of a profile curve of a conductive support is negative, and the profile curve, indicated with a solid line, on the surface of the conductive support is structured with roundish convex portions and concave portions with a sharp acute angle. In FIGS. 6(*a*) and 6(*b*), a dotted line represents an average line.

As a method of providing these regular convexo-concave patterns to a surface of a conductive support, first, a cutting processing treatment is applied to the surface of the conductive support. Concretely, as mentioned later, such a convexo-concave configuration can be formed by the selection of the material and shape of a cutting tool used in cutting work with a technique to appropriately determine an amount of cut-in, a feed pitch and a rotation speed at the time of the cutting work.

After the conductive support has been subjected to the cutting work as mentioned above, next, sandblasting, dry ice blasting, high pressure jet water treatment, and the like are applied to the surface of the conductive support while jetting pressures and spraying pressure are being adjusted suitably. With such a procedure, it becomes possible to form the conductive support with the surface having the skewness of a profile curve being in the range specified by the present invention.

In cutting work with a cutting tool, taken is a method with which, for example, a cutting tool composed of a polycrystal diamond sintered compact is used in rough processing, thereafter, a cutting tool (called a diamond cutting tool) of a natural diamond, a single crystal diamond, or a polycrystal diamond is used in finish processing. As a diamond cutting tool employing a single crystal diamond, a nose configuration may be either a flat configuration or an R configuration (roundish configuration), and, in the case of an R configuration, it is desirable that the radius of a used nose is about 10 to 30 mm. Further, as a cutting tool composed of a polycrystal diamond sintered compact, a nose configuration may be either a flat configuration or an R configuration, and, in the case of an R configuration, it is desirable to use a cutting tool with a grain size of 0.2 μm or more and 15 μm or less.

Further, a cutting surface of a cutting tool is preferably polished such that the polish-finishing roughness on the surface becomes 0.3 μm or more and 2.0 μm or less as the maximum roughness Rt. The maximum roughness Rt on a cutting surface of a cutting tool can be measured by the use of surface roughness meters, such as a surface roughness meter "SURFCOM 1400D" (manufactured by Tokyo Seimitsu Co., Ltd.) mentioned above. The grinding of a cutting tool is preferably conducted with a diamond wheel mounted to a tool grinding disc.

As cutting work conditions, for example, it is preferable to set a rotation speed to 3000 to 8000 rpm and an amount of cut-in to 0.001 to 0.2 mm. Further, a feed pitch may be set within the range that the minimum value is preferably 100 μm/rev or more, more preferably 150 μm/rev or more, and the maximum value is preferably 600 μm/rev or less, more preferably 450 μm/rev or less.

The skewness (Rsk) of a profile curve of the present invention may be achieved with reference to JPA (Japanese Unexamined Patent Publication) No. 2007-264379 about a cutting work; JPA No. 2005-292565 about a dry-ice blasting method; JPA Nos. 2000-105481 and 2000-155436 about a sandblasting method; and JPA No. 2006-30580 about a high pressure jetting method.

The configuration of an electrically conductive support used for the photoreceptor relating to the present invention may be a sheet shape or a cylinder shape, however the cylinder shape is preferable, and then, a conductive support with a cylinder shape is specifically referred to as "cylindrical conductive support". Hereafter, "cylindrical conductive support" is also referred to as "drum".

The cylindrical conductive support in the present invention refers to a support with a cylinder shape which enables an endless image formation by rotation, and is preferably a conductive support being within a range of 0.1 mm or less in straightness and a range of 0.1 mm or less in deflection. With the straightness and deflection being made within the above range, a good image formation can be achieved.

A cylindrical conductive support used for the photoreceptor relating to the present invention preferably has a diameter of 10 to 300 mm, and more preferably 10 to 50 mm. In the photoreceptor employing a small diameter cylindrical conductive support with a diameter of 10 to 50 mm, the effects of the present invention appear appreciably and the effects become remarkable, that is, the adhesive property between the support and an intermediate layer is improved and, simultaneously, the occurrence of black spots is prevented.

Examples of materials of a cylindrical conductive support include, for example, metal drums such as aluminum and nickel, a plastic drum on which aluminum, tin oxide, indium oxide or the like is deposited, and a paper drum or plastic drum on which electrically conductive materials are coated. Further, the cylindrical conductive support preferably has a specific resistivity of $10^3$ Ωcm or less at ordinary temperature.

The conductive support usable in the present invention may be subjected to a pore sealing treatment to form an alumite layer on its surface. The alumite treatment is conducted usually in an acidic bath such as chromic acid, sulfuric acid, oxalic acid, phosphoric acid, boric acid, or sulfamic acid. Among these, an anodizing treatment (anodic oxidation treatment) in sulfuric acid provides the most preferable results. The anodizing treatment in sulfuric acid is preferably conducted with a sulfuric acid concentration of 100 to 200 g/l, an aluminum ion concentration of 1 to 10 g/l, a liquid temperature of approximately 20° C. and an applied voltage of approximately 20 V, but the anodizing treatment is not limited to these conditions. The thickness of an anodic-oxidation film is preferably 20 μm or less usually, and more preferably 10 μm or less.

Hereafter, a concrete structure of a photoreceptor preferably used in the present invention will be described.

Conductive Support (Electrically Conductive Support)

A conductive support used for the photoreceptor relating to the present invention has the characteristics mentioned above.

Further, the conductive support used for the photoreceptor relating to the present invention is preferably prepared such that its surface roughness as a ten-point mean roughness (Rz) is from 0.5 to 2.5 μm, more preferably 0.5 to 1.8 μm. The conductive support processed so as to be provided with such a surface roughness is preferable, because it is easy to provide a structure of the skewness of a profile curve being within the abovementioned range specified in the present invention. The provision of an intermediate layer containing N-type semiconductor particles mentioned later on such a conductive support makes it possible to prevent insulation breakdown and the occurrence of black spots, further to prevent effectively the occurrence of moiré at the time of using interference light beam such as laser or the like. Herein, the definition and measuring method of the surface roughness Rz (ten-point mean roughness) are as follows.

Definition and Measuring Method of Surface Roughness Rz

The above surface roughness Rz represents "a ten-point mean roughness" described in JIS B 0601-1982. That is, the surface roughness Rz is the value of the difference between the average height of five mountain peaks from the highest level and an average depth of five valley bottoms from the lowest level on distances of the standard value of a reference length.

Measurement Conditions

Measurement device: Surface roughness meter (SURFCOM 1400D, manufactured by Tokyo Seimitsu Co., Ltd.)

Measurement length (L): Standard value of reference length

Stylus tip configuration: Cone with a tip angle 60°

Stylus tip radius: 0.5 μm

Measurement rate: 0.3 mm/sec

Measurement magnification: 100,000 times

Measurement position: three positions at upper, intermediate and lower positions (three positions in total of a center and middle points between the center and end portions in the width direction on a photosensitive layer side surface of a conductive support)

The average value of Rz values at the foregoing three positions is defined as a value of Rz.

Intermediate Layer

Next, an intermediate layer that constitutes the photoreceptor relating to the present invention will be explained.

The photoreceptor relating to the present invention is provided with an intermediate layer having a barrier function between a conductive support and a photosensitive layer (composed of a charge generating layer and a charge transporting layer).

That is, the provision of an intermediate layer between a conductive support and a photosensitive layer can improve the adhesive property between the conductive support and the photosensitive layer (composed of a charge generating layer and a charge transporting layer) and can provide a barrier function to prevent the charge injection from the conductive support toward the photosensitive layer. Further, it is preferable to make the intermediate layer to contain particles called "N type semiconductive particles" represented by titanium oxide or zinc oxide.

Herein, the N-type semiconductive particles refer to fine particles to provide the intermediate layer with a nature that conductive carriers are restricted to electrons. Namely, when the N-type semiconductive particles is contained in a insulating binder constituting an intermediate layer, the intermediate layer becomes to have a nature that blocks the injection of holes being positive charge from the support to the photosensitive layer and, on the other hand, does not block the shift of electrons from the photosensitive layer.

Specific examples of the N-type semiconductive particle include titanium oxide ($TiO_2$), zinc oxide (ZnO), and tin oxide ($SnO_2$). Among them, titanium oxide and zinc oxide are preferable.

The N-type semiconductive particle used in the present invention has preferably a number average primary particle diameter of 10 nm or more and 200 nm or less, more preferably 15 to 150 nm. An intermediate layer coating liquid employing N-type semiconductive particles having a number average primary particle diameter in the above range exhibits excellent dispersion stability. Further, an intermediate layer formed with this coating liquid has a function to prevent the occurrence of black spots and, in addition, exhibits excellent environmental characteristics and cracking resistance.

The number average primary particle diameter of the N-type semiconductive particles is obtained in such a way that for example, the particles are enlarged by 10000 times with a transmission electron microscope, 100 particles are randomly selected from the enlarged image and are subjected to image analysis so as to obtain their respective Fere direction diameter, and then the number average primary particle diameter is calculated as an Fere direction average diameter.

The N-type semiconductive particles used in the present invention have shapes such as a dendritic shape, a needle shape, and a granular shape. In the N-type semiconductive particles with such shapes, for example, titanium oxide particles include crystal types such as an anatase type, a ruffle type and a mixed type in which an amorphous type is mixed in the crystal types. In the present invention, any one of the crystal types may be employed, and two or more kinds of the crystal types may be employed as a mixture. Among them, the rutile type particles are most preferable.

Further, N-type semiconductive particles having been subjected to surface treatment may be contained in an intermediate layer. In a concrete example of the surface treatment to be conducted for N-type semiconductive particles, for example, after particles are subjected to surface treatment by plural times, the particles are subjected finally to surface treatment by the use of a reactive organic silicon compound. In this method in which the surface treatment is conducted by the use of a reactive organic silicon compound after surface treatment has been conducted by plural times, it is preferable that surface treatment by the use of at least one compound of selected from alumina, silica, and zirconia is conducted at least one time, and then finally, surface treatment is conducted by the use of the reactive organic silicon compound.

The above surface treatment employing alumina, silica, or zirconia is treatment to precipitate alumina, silica, or zirconia on the surfaces of N-type semiconductive particles, and such precipitated alumina, silica, or zirconia includes the hydrate of alumina, silica, or zirconia. Further, the above surface treatment employing the reactive organic silicon compound is treatment conducted by the use of a treatment liquid containing a reactive organic silicon compound.

In the above way, the surface treatment conducted on N-type semiconductive particles makes the N-type semiconductive particles to exhibit good dispersibility in an intermediate layer, whereby the occurrence of image defects such as black spots can be prevented and performances such as environmental adaptabilities, and cracking resistant properties can be enhanced.

The abovementioned intermediate layer can be formed in such a way that N type semiconductive particles, such as titanium oxide and zinc oxide are dispersed in a solvent together with binder resin so as prepare a intermediate layer forming coating liquid, and the resultant coating liquid is coated on a conductive support.

The intermediate layer forming coating liquid includes N type semiconductive particles, binder resin, a dispersing solvent, and the like, and as the dispersing solvent, a solvent similar to those used at the time of forming other layers, such as a charge generating layer and a charge transporting layer, may be employed.

Examples of binder resin usable for the intermediate layer include: thermoplastic resins, such as polyamide resin, polyvinyl acetate resin, polyvinyl acetal resin, polyvinyl butyral resin, and polyvinyl alcohol resin; thereto hardening resins, such as melamine resin, epoxy resin, and alkyd resin; and copolymer resins containing at least two kinds of the repeating units of the resins mentioned above. Among the above binder resins, polyamide resin is preferable. In the polyamide resin, more preferable is alcohol-soluble polyamide resin which is formed by copolymerization or methoxymethylol process.

The additive amount of N-type semiconductive particle dispersed in binder resin is preferably 10 to 10,000 parts by mass, more preferably 50 to 1,000 parts by mass to 100 parts by mass of the binder resin. When the additive amount of N-type semiconductive particle is made within the above range, the dispersibility of the N-type semiconductive particle in an intermediate layer can be maintained well, whereby an excellent intermediate layer without causing image defects such as black spots can be formed.

At the time of preparing an intermediate layer for riling coating liquid, it is desirable to use a dispersing means, such as a sand mill, a ball mill, and ultrasonic dispersion, for dispersing N type semiconductive particles uniformly.

The thickness of an intermediate layer is preferably 0.2 to 15 μm, more preferably 0.3 to 10 μm, and still more preferably 0.5 to 8 μm.

Photosensitive Layer (a Charge Generating Layer and a Charge Transporting Layer)

Next, a photosensitive layer (a charge generating layer and a charge transporting layer) constituting the photoreceptor relating to the present invention will be explained. The photosensitive layer constituting the photoreceptor relating to the present invention has a structure in which the photosensitive layer is separated into a charge generating layer (also referred to CGL) and a charge transporting layer (also referred to CTL). In this way, with the structure in which the function of the photosensitive layer is separated into a charge generating layer (CGL) and a charge transporting layer (CTL), the increase of a residual electric potential due to repeated use can be controlled to be small. Further, it is easy to control other electrophotographic characteristics in accordance with the objects, as compared with a single layer structure in which the charge generating function and the charge transporting function are provided to a single layer.

A photoreceptor for negatively charging preferably has a layer structure that a charge generating layer (CGL) is provided on an intermediate layer and a charge transporting layer (CTL) is provided on the charge generating layer. On the other hand, a photoreceptor for positively charging preferably has a layer structure that the layer constituting order is reverse to that of a photoreceptor for negatively charging, that is, a charge transporting layer (CTL) is provided on an intermediate layer and a charge generating layer (CGL) is provided on the charge transporting layer. In the present invention, preferred is a photoreceptor for negatively charging having a function separating type structure that a charge generating layer (CGL) is provided on an intermediate layer and a charge transporting layer (CTL) is provided on the charge generating layer.

Hereafter, a charge generating layer and a charge transporting layer which constitute a photoreceptor for negatively charging of a function separating type will be explained.

Charge Generating Layer

The charge generating layer contains a charge generating material (CGM) and can also contain binder resin and well-known additives, if needed, in addition to the charge generating material.

In the photoreceptor relating to the present invention, a metal phthalocyanine pigment is employed as the charge generating material (CGM). The "metal phthalocyanine pigment" referred in the present invention is a pigment composed of a compound which has a structure in which an ionized metal atom is arranged at the center of a phthalocyanine ring. Examples of the metal atom constituting the "metal phthalocyanine pigment" referred in the present invention include: for example, titanium, gallium, vanadium, copper, zinc, and the like.

In the present invention, preferred are a gallium phthalocyanine pigment with a structure in which gallium atoms are arranged, and a titanyl phthalocyanine pigment with a structure in which titanium atoms are arranged. Since the gallium phthalocyanine pigment and the titanyl phthalocyanine pigment have strong characteristics, they hardly deteriorate chemically for short wavelength laser beams and have a relatively high sensitivity for short wavelength laser beams. However, since they have such a characteristic that easily receives charge injection from a conductive support, they have a problem in forming a latent image stably.

In the present invention, a charge generating layer containing such a metal phthalocyanine pigment is applied with a conductive support having a skewness (Rsk) of a profile curve being in a range of $-8<Rsk<0$ so that it become possible to prevent charge from being injected from the conductive support. Accordingly, it also becomes possible to prevent the occurrence of image defects such as reverse black spots and streaks-like density unevenness caused by the charge injection from the conductive support, and high minute dot latent images can be formed faithfully by the irradiation of short wavelength laser beams with the action of its high sensitive characteristic. As a result, the reproducibility of minute image data has been improved and at the time of forming a halftone image, it becomes possible to form an electrophotographic image with high quality without streaks-like density unevenness.

In the photoreceptor relating to the present invention, a charge generating layer is made to contain a metal phthalocyanine pigment. Among such a metal phthalocyanine pigment, preferred are a gallium phthalocyanine pigment with a structure in which gallium atoms are arranged, and a titanyl phthalocyanine pigment with a structure in which titanium atoms are arranged.

The metal phthalocyanine pigments usable in the present invention have a crystal structure which shows a peak at a specific diffraction angle (also referred to as a Bragg angle) ($2\theta\pm0.2°$) in the X-ray diffraction spectrum with Cu-Kα as a radiation source. Here, the peak is indicated as a protruding portion with an acute angle on a spectrum chart produced by the X-ray diffraction spectrum measurement, and the peak is clearly different in shape from noises in the spectrum chart.

In the present invention, among the gallium phthalocyanine pigments contained in the charge generating layer, a hydroxy gallium phthalocyanine pigment and a chloro gallium phthalocyanine pigment are more preferable. Further, preferred is a hydroxy gallium phthalocyanine pigment having a peak at 7.4° and 28.2° on a diffraction angle ($2\theta\pm0.2°$) in the Cu-Kα characteristic X ray diffraction. Also, preferred is a chloro gallium phthalocyanine pigment having a peak at 7.4°, 16.6°, 25.5° and 28.3° on a diffraction angle ($2\theta\pm0.2°$) in the Cu-Kα characteristic X ray diffraction.

In the present invention, among the titanyl phthalocyanine pigments contained in the charge generating layer, a Y-type oxy titanyl phthalocyanine pigment is more preferable, and the Y-type oxy titanyl phthalocyanine pigment has a peak at 27.2° on a diffraction angle ($2\theta\pm0.2°$) in the Cu-Kα characteristic X ray diffraction.

In this way, the metal phthalocyanine pigments usable in the present invention have a crystal structure which shows a peak at a specific diffraction angle (also referred to as a Bragg angle) ($2\theta\pm0.2°$) in the X-ray diffraction spectrum with Cu-Kα as a radiation source. Further, the metal phthalocyanine pigments usable in the present invention may have a peak at the other diffraction angle in addition to the peak at a specific diffraction angle ($2\theta\pm0.2°$) to specify each composition.

Here, the measuring method of the X-ray diffraction spectrum with Cu-Kα as a radiation source will be explained. As a measuring method of the X-ray diffraction spectrum with Cu-Kα as a radiation source, for example, well-known measuring methods, such as a powder method and a thin film method, are employable, and these methods use Cu-Kα (a wavelength of 1.54178 Å) as a X radiation source. Hereafter, the thin film method which is one of the measuring methods of an X-ray diffraction spectrum is explained.

In the X-ray diffraction spectrum measurement by the thin film method, there is a merit in which a thin film X-ray diffraction spectrum of a photosensitive layer itself can be obtained. As an example of the measuring methods, there is a method in which a photosensitive layer is formed on a glass surface and the resultant photosensitive layer is subjected to a measurement. Hereafter, the procedures of the measuring method of the X-ray diffraction spectrum of the photosensitive layer with Cu-Kα as a radiation source are explained more concretely.

(1) Production of Test Samples

A coating liquid for forming a photosensitive layer is coated on a nonreflective cover glass such that the thickness of the coated film after being dried becomes 10 μm or less, and the coated film is dried.

(2) Measuring Device and Measurement Conditions

As a measuring device to measure an X-ray diffraction spectrum, employed is an X-ray diffractometer for measuring thin film samples with a radiation source of the Cu-Kα rays which are made monochrome parallel rays with artificial multilayer film mirrors. For example, "RIGAKU RINT2000 (manufactured by Rigaku Co., ltd.)" may be employed. The measurement conditions of an X-ray diffraction spectrum are as follows. Namely, X ray output voltage: 50 kV
X ray output electric current: 250 mA
Fixed incidence angle (θ): 1.0°
Scanning range (2θ): 3 to 40°
Scanning step width: 0.05°
Incidence soller slit: 5.0°
Incidence slit: 0.1 mm
Light receiving soller slit: 0.1°

An X-ray diffraction spectrum measurement can be conducted by the setting of the above measurement conditions.

Moreover, as same as the charge generating layer containing metal phthalocyanine pigments, such as the abovementioned gallium phthalocyanine pigments, a charge generating layer containing an azo pigment represented by the following general formula (1) as a charge generating material (CGM) has a relatively high sensitivity for short wavelength laser beams, but has such a characteristic that easily receives charge injection from a conductive support.

A charge generating layer containing such an azo pigment is applied with a conductive support having a skewness (Rsk) of a profile curve being in a range of $-8<Rsk<0$ so that it become possible to prevent charge from being injected from the conductive support while maintaining high sensitivity by the pigment. Accordingly, when an image formation is conducted with a photoreceptor having a charge generating layer containing an azo pigment, it also becomes possible to prevent the occurrence of image defects such as reverse black spots and streaks-like density unevenness caused by the charge injection. As a result, high minute dot latent images is formed faithfully by the irradiation of short wavelength laser beams so that the dot reproducibility has been improved. Further, at the time of forming a halftone image, it becomes possible to form an electrophotographic image with high quality without causing streaks-like density unevenness on the image.

As mentioned above, an azo pigment is represented by the following general formula (1).

Formula (1)

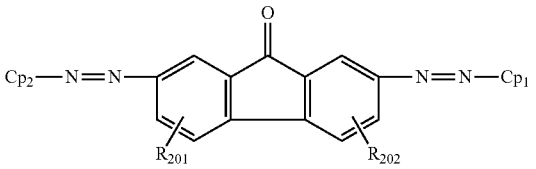

In the formula, $R_{201}$ and $R_{202}$ each represents any one of a hydrogen atom, a halogen atom, an alkyl group, an alkoxy group, and a cyano group, respectively, and $R_{201}$ and $R_{202}$ may be the same to or different from each other. Further, in the formula, $C_{p1}$ and $C_{p2}$ each is a group represented by the following formula (1a), and $C_{p1}$ and $C_{p2}$ may be the same to or different from each other.

(1a)

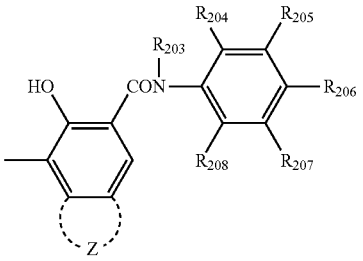

In the formula (1a), $R_{203}$ represents a hydrogen atom, an alkyl group, or an aryl group. $R_{204}$, $R_{205}$, $R_{206}$, $R_{207}$, and $R_{208}$ each represents a hydrogen atom, a nitro group, a cyano group, a halogen atom, a hydrogenate alkyl group, an alkyl group, an alkoxy group, a dialkylamino group, or a hydroxyl group, respectively. Further, Z represents a substituted or unsubstituted aromatic carbon ring or an atomic group required to constitute a substituted or unsubstituted aromatic carbon ring.

Next, specific examples of the compound of an azo pigment represented by the general formula (1) are shown below.

Azo CGM-1

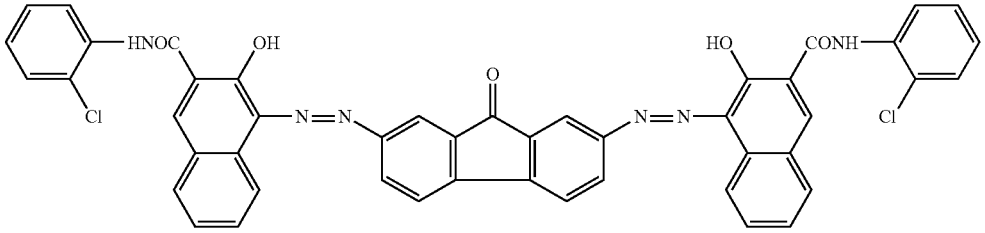

Azo CGM-2

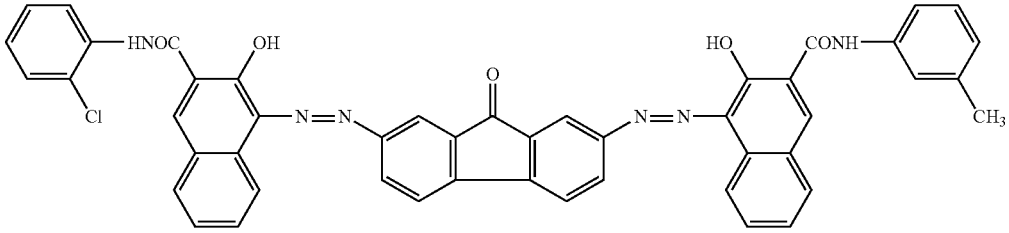

Further, in the case where a binder is used as a dispersion medium of CGM for a charge generating layer well-known resin may be used as a binder. Examples of the most preferable resin as a binder usable for a charge generating layer, include: for example, formal resin, butyral resin, silicone resin, silicone modified butyral resin, phenoxy resin, and the like. It may be considered that the use of these resins makes the abovementioned metal phthalocyanine pigment to be dispersed uniformly into the charge generating layer and contribute to make the increase of the residual potential due to the repeated use to be smaller. The ratio of binder resin and a charge generating material in a charge generating layer is preferably 20 to 600 mass parts of the charge generating material to 100 mass parts of the binder resin. The thickness of the charge generating layer is preferably 0.01 μm to 2 μm.

Charge Transporting Layer

The charge transporting layer contains a charge transporting material (CTM) and can also contain binder resin and well-known additives, such as an antioxidant if needed, in addition to the charge transporting material.

The charge transporting material (CTM) has preferably a high mobility, and an ionized potential difference between the charge transporting material and a combined charge generating material is preferably 0.5 (eV) or less, and more preferably 0.25 (eV) or less. It may be considered that a charge transporting material having such characteristics contributes to suppress the increase of the residual potential due to repeated use to the smallest. The ionized potential of the charge generating material (CGM) and a charge transporting material (CTM)) can be measured with well-known measuring devices, such as a surface analyzer AC-1 (manufactured by Riken Keiki Co., Ltd.).

As the charge transporting material (CTM), well-know charge transporting materials (CTM), such as a triphenylamine derivative, a hydrazone compound, a styryl compound, a benzidine compound, and a butadiene compound, may be employed. The charge transporting layer can be formed usually with a liquid in which above charge transporting materials are dissolved into a suitable binder resin.

Examples of the binder resin for the charge transporting layer (CTL) include: for example, a polystyrene resin, an acrylic resin, a methacrylic resin, a vinyl acetate resin, a polyvinyl butyral resin, an epoxy resin, a polyurethane resin, a phenol resin, a polyester resin, an alkyd resin, a polycarbonate resin, a silicone resin, a melamine resin, and a copolymer resin containing at least two kinds of the repeating units of these resins.

The most desirable resin as the binder resin for the abovementioned charge transporting layers is a polycarbonate resin. The polycarbonate resin is most preferably, because it enhances the dispersibility of the charge transporting materials and contributes to improve the electrophotographic characteristics. The ratio of binder resin and a charge transporting material is preferably 10 to 200 mass parts of the charge transporting material to 100 mass parts of the binder resin. The thickness of the charge transporting layer is preferably 10 μm to 40 μm.

Surface Layer

As mentioned above, the electrophotographic photoreceptor relating to the present invention comprises at least an intermediate layer, a charge generating layer, and a charge transporting layer on a conductive support, and may further comprises a surface layer (protective layer) if needed.

Next, a production method of the electrophotographic photoreceptor relating to the present invention will be explained. The electrophotographic photoreceptor relating to the present invention can be produced by well-known methods in such a way that a coating liquid for forming an intermediate layer, a coating liquid for forming a charge generating layer, and a coating liquid for forming a charge transporting layer are sequentially coated on a conductive support.

As a method for coating a coating liquid for each layer, well-known coating methods can be employed. Specifically, coating processing methods, such as a dip coating method, a spray coating method, and an amount regulating type coating method, can be employed. Here, an amount regulating type coating method is a coating method which conducts coating while controlling the thickness of each coating layer by regulating a coating amount, and its typical example is a coating method with a coating device called a round shape slide hopper.

In the case where layers are formed by coating, it is required that when an upper layer is formed, a lower layer film having been already coated is not dissolved as much as possible, and that uniform coating processing can be performed smoothly. As a coating method capable of clearing such requests without applying time and effort, it is preferable to employ a spray coating method or an amount regulating type coating method among the abovementioned methods. The spray coating method is described in detail in Japanese Unexamined Patent Publication Nos. HEI3-90250 and HEI 3-269238, and the amount regulating type coating method is described in detail in Japanese Unexamined Patent Publication No. SHO 58-189061.

Examples of the abovementioned amount regulating type coating devices include: a round shape slide hopper type coater head and an extrusion type coater head. Among these, a coating device comprising a below-mentioned round shape slide hopper type coater head (hereafter, also referred to as a round shape slide hopper type coating device or a slide type coating device) is preferable. As compared with a dip coating method which conducts coating in such a way that the almost entire body (except a part of an upper end portion) of a cylindrical conductive support is dipped in a coating liquid, a coating device comprising such a round shape coater head can form a layer in one way flow without staying a coating liquid in the coating device.

Further, since coating-layer thickness is accurately controllable by the flow rate of a coating liquid discharged out from a coating device, variation in thickness is little, and in the case of forming a surface protective layer, an optically-uniform layer can be formed.

As a solvent or a dispersion medium used at the time of producing a coating liquid for forming an intermediate layer, a charge generating layer, and a charge transporting layer which constitute the electrophotographic photoreceptor relating to the present invention, the following may be employed. Namely, examples of a solvent or a dispersion medium include: n-butylamine, diethylamine, ethylenediamine, isopropanolamine, triethanolamine, triethylenediamine, N,N dimethylformamide, acetone, methyl ethyl ketone, methyl isopropyl ketone, cyclohexanone, benzene, toluene, xylene, tetrahydrofuran, dioxolane, dioxane, methanol, ethanol, 1-propanol, butanol, isopropanol, ethyl acetate, butyl acetate, dimethyl sulfoxide, methyl cellosolve, and the like. These solvents may be used independently or in combination of at least two kinds as a mixed solvent.

When each layer is formed, dry unevenness may occur at the time of drying a coating layer. In order to prevent such dry unevenness, it is desirable to use a mixed solvent composed of a solvent having high solubility for resin and a solvent having characteristic which keeps proper evaporation rate, such as a mixed solvent of methanol and linear alcohol. Since such a mixed solvent keeps proper evaporation rate of a solvent, it becomes possible to prevent the occurrence of image defects accompanying dry unevenness at the time of drying a coating layer.

Next, an image forming apparatus and image forming method which employs the electrophotographic photoreceptor relating to the present invention will be explained.

The image forming method employing the electrophotographic photoreceptor relating to the present invention comprises at least the following processes, namely, (1) an electrostatic latent image forming process of forming an electrostatic latent image on an electrophotographic photoreceptor with an exposure beam so called a short wavelength beam having a wavelength of 350 nm or more and 500 nm or less;

(2) a developing process of developing the electrostatic latent image formed on the electrophotographic photoreceptor with a developer containing a toner so as to form a toner image;

(3) a transferring process of transferring the toner image formed on the electrophotographic photoreceptor on a transfer member, such as a sheet; and (4) a fixing process of fixing the toner image transferred on the transfer member.

The image forming method may further comprises other processes in addition to the above four processes. For example, the image forming method may further comprises a cleaning process of removing toner remaining on the surface of the electrophotographic photoreceptor after the toner image has been transferred.

Further, in the transferring process, some of the image forming method may transfer a toner image from an electrophotographic photoreceptor to a recording medium such as a sheet through an intermediate transfer member. Further, in the developing process, an electrostatic latent image can be developed with the application of a developing bias in which an AC bias is superimposed on a DC bias.

In the present invention, a latent image is formed on a photoreceptor by the irradiation of an exposure beam generally called a short wavelength exposure beam having a wavelength of 350 nm to 500 nm, and a semiconductor laser and a light emitting diode are used as a light source of the exposure beam. From these exposure light sources, an exposure beam with an exposing dot diameter, in a write-in main scanning direction, of 5 to 50 μm, preferably 10 to 25 is irradiated on a photoreceptor so that digital exposure is performed. With such an exposure means, on a photoreceptor, formed is a dot latent image with an image write-in density of 1200 to 6000 dpi (dpi: the number of dots per inch, 1 inch=2.54 cm), whereby an image formation with high image resolution can be performed. Incidentally, in the case where an image write-in density is 600 dpi, an exposure dot diameter is 42.3 μm, in the case where an image write-in density is 1200 dpi, an exposure dot diameter is 21.7 μm, and in the case where an image write-in density is 2400 dpi, an exposure dot diameter is 10.5 μm.

Here, an exposure dot diameter is the size (length, width) of an exposure beam, and specifically the exposure dot diameter is a length, along a main scanning direction, of a region where the intensity of an exposure beam becomes more than $1/e^2$ of a peak intensity. In the case where an exposure dot diameter is smaller than the thickness of a photosensitive layer, the image resolution of a latent image becomes raised, however when an exposure dot diameter is too small, there is fear that the reproducibility of an amount of developed toner may become unstable.

In the present invention, even when exposure is conducted with an image write-in density of 1200 dpi or more, a dot latent image corresponding to an exposure beam dot of 21.7 μm or less can be funned on an electrophotographic photoreceptor. Further, as shown also in Examples mentioned later, a minute and high image resolution toner image represented by a photograph image can be formed stably.

Next, an image forming apparatus capable of employing an electrophotographic photoreceptor relating to the present invention will be explained. The image forming apparatus 1 shown in FIG. 1 is a digital image forming apparatus. It comprises an image reading section. A, an image processing section B, an image forming section C, and a transfer paper conveyance section D as a transfer paper conveyance means.

An automatic document feed means for automatically feeding documents is arranged on the top of the image reading section A. The documents placed on the document platen as conveyed sheet by sheet by means of a document conveying roller 12, and the image is read at the reading position 13*a*. The document having been read is ejected onto a document ejection tray 14 by the document conveying roller 12.

On the other hand, in the case where the reading operation is conducted for the image of the document placed on the plate glass 13, the image of the document is read by an illumination lamp constituting a scanning optical system and a plurality of mirror units 15 and 16 composed of plural mirrors.

The images read by the image reading section A are formed on the light receiving surface of an image-capturing device (CCD) through the projection lens 17. The optical images formed on the image-capturing device (CCD) are sequentially subjected to photoelectric conversion into electric signals (luminance signals). Then they are subjected to analog-to-digital conversion, and then to such processing as density conversion and filtering in the image processing section B. After that, image data is stored in the memory.

The image forming section C comprises a photoreceptor 1 relating to the present invention. Around the photoreceptor 1, provided are a charging device 2 for charging the photoreceptor 1 on the outer periphery; a potential detecting section 220 for detecting the potential on the surface of the charged photoreceptor; a developing section 4; a transfer/conveyance belt apparatus 5 as a transfer section; a cleaning apparatus 6 for the photoreceptor 1; and a PCL (pre-charge lamp) 8 as an optical electric charge eliminator. These components are arranged in the order of operations. Further, a reflected density detecting section 222 for measuring the reflected density of the patch image developed on the photoreceptor 1 is provided downstream from the developing section 4. A photoreceptor of the present invention is used as the photoreceptor 1, and is driven in the clockwise direction as illustrated.

The photoreceptor 1 is electrically charged uniformly by the charging device 2. After that image exposure is performed based on the image signal called up from the memory of the image processing section B by an image exposure section 3. Image exposure is carried out at position Ao for the photoreceptor 1 by the image exposure section 3, so that an electrostatic latent image is formed on the surface of the photoreceptor 1.

As mentioned above, at the time of forming an electrostatic latent image on a photoreceptor, an image forming apparatus according to the present invention can employ an image exposure light source with an oscillation wavelength of 350 to 500 nm such as a semiconductor laser or a light emitting diode. By the use of such an image exposure light source, it becomes possible to conduct digital exposure on a photoreceptor with an exposure beam whose exposure dot size is narrowed to 10 to 50 in the main scanning direction for writing, whereby microscopic dot image can be formed.

The electrostatic latent image on the photoreceptor 1 is developed by the developing means 4, and a toner image is formed on the surface of the photoreceptor 1. In the image forming method of the present invention, it is desirable to use a polymer toner as the developing agent used in said development means. By combining the use of polymer toner with uniform shape or particle distribution with an organic photoreceptor according to the present invention, it is possible to obtain an electro-photographic image with increased sharpness and good quality.

In the transfer paper conveyance section D, sheet feed units 41(A), 41(B) and 41(C) as a transfer sheet storage means are arranged below the image forming unit, wherein the transfer sheets P having different sizes are stored. A manual sheet feed unit 42 for manual feed of the sheets of paper is provided on the side. The transfer sheets P selected by either of the two are fed along a sheet conveyance path 40 by a guide roller 43, and are temporarily suspended by the sheet feed registration roller 44 for correcting the inclination and deviation of the transfer sheets P. Then these transfer sheets P are again fed and guided by the sheet conveyance path 40, pre-transfer roller 43*a*, paper feed path 46 and entry guide plate 47. The toner image on the photoreceptor 1 is transferred to the transfer sheet P at the transfer position Bo by a transfer electrode 24 and a separator electrode 25, while being carried by the transfer/conveyance belt 454 of the transfer/conveyance belt apparatus 45. The transfer sheet P is separated from the surface of the photoreceptor 1 and is brought to a fixing apparatus 50 as a fixing means by the transfer/conveyance belt apparatus 45.

The fixing apparatus 50 contains a fixing roller 51 and a pressure roller 52. When the transfer sheet P passes between the fixing roller 51 and pressure roller 52, toner is fixed in position by heat and pressure. With the toner image having been fixed thereon, the transfer sheet P is ejected onto the ejection tray 64.

The above description is an explanation for the case where an image is formed on one side of the transfer sheet. In the case of duplex copying, the ejection switching member 170 is switched and the transfer sheet guide 177 is opened. The transfer sheet P is fed in the direction of an arrow showed in a broken line. Further, the transfer sheet P is fed downward by the conveyance device 178 and is switched back such that the trailing edge of the transfer sheet P becomes the leading edge, and then the transfer sheet P is conveyed again into the sheet conveyance path 40 by the operations of the conveying guide 131 and a sheet conveying roller 132 in the sheet feed unit 130 for duplex copying, whereby a toner image can be formed on the reverse surface of the transfer sheet P with the abovementioned procedures.

The image processing apparatus can be configured in such a way that the components such as the aforementioned photoreceptor, developing device and cleaning device are integrally combined into a process cartridge, and this unit is removably mounted on the apparatus proper. It is also possible to arrange such a configuration that at least one of the charging device, image exposure device, developing device, transfer electrode, separator electrode and cleaning device is supported integrally with the photoreceptor, so as to form a process cartridge that, as a removable single unit, is mounted on the apparatus proper, using a guide means such as a rail of the apparatus proper.

Figure 2:
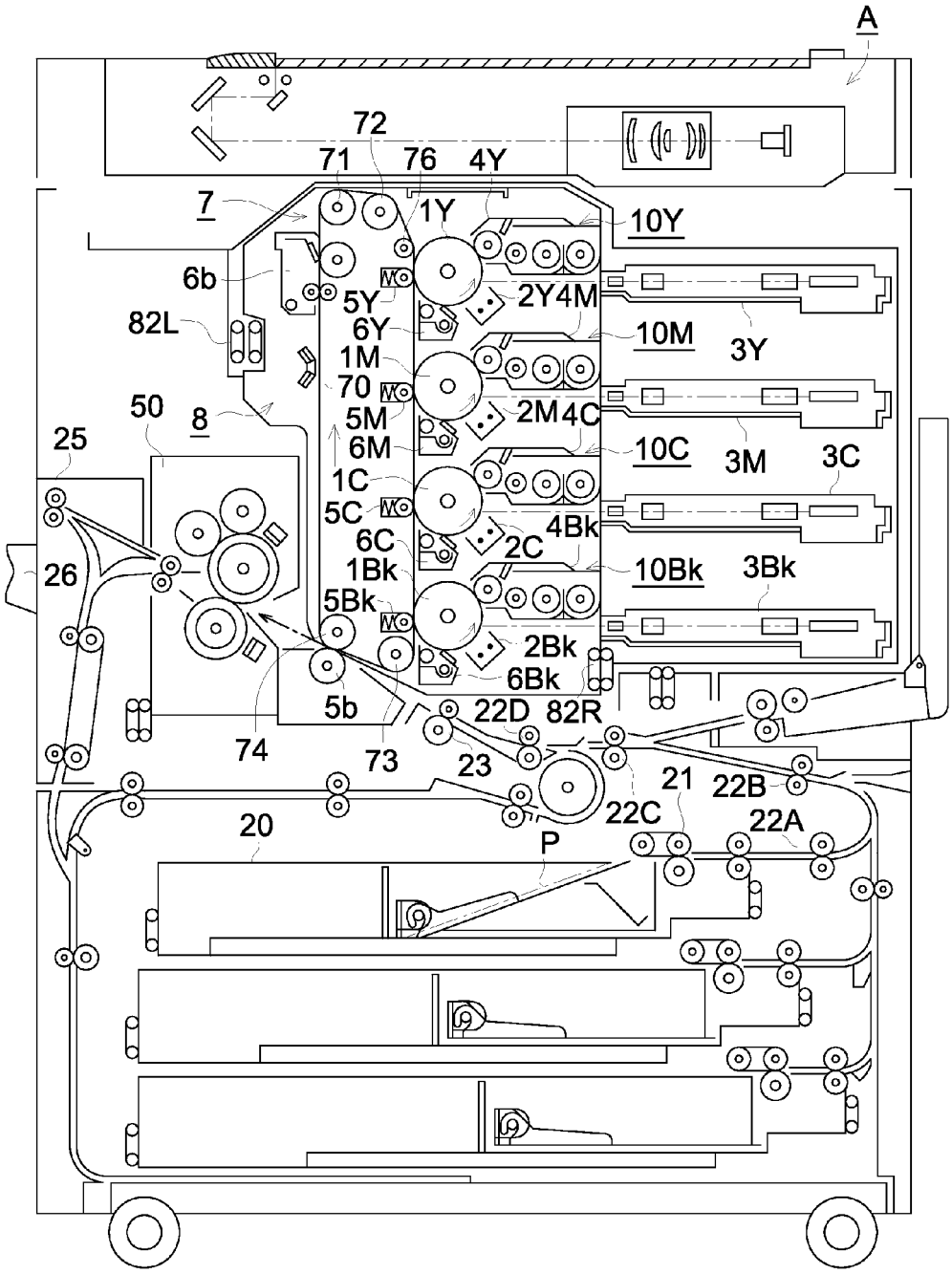
FIG. 2 is a cross-sectional structural diagram of a color image forming apparatus showing one embodiment of the present invention.

FIG. 2 is a cross-sectional structural diagram of a color image forming apparatus on which the electrophotographic photoreceptor relating to the present invention can be mounted.

This color image forming apparatus is of the so called tandem type color image forming apparatus, and comprises four sets of image forming sections (image forming units) 10Y, 10M, 10C, and 10Bk, an endless belt shaped intermediate image transfer body unit 7, a sheet feeding and transportation means 21, and a fixing means 24. The original document reading apparatus A is placed on top of the main unit A of the image forming apparatus.

The image forming section 10Y that forms images of yellow color comprises a charging means (charging process) 2Y, an exposing means (exposing process) 3Y, a developing means (developing process) 4Y, a primary transfer roller 5Y as a primary transfer means (primary transfer process), and a cleaning means 6Y all placed around the drum shaped photoreceptor 1Y which acts as the first image supporting body. The image forming section 10M that forms images of magenta color comprises a drum shaped photoreceptor 1M which acts as the first image supporting body, a charging means 2M, an exposing means 3M, a developing means 4M, a primary transfer roller 5M as a primary transfer means, and a cleaning means 6M. The image forming section 10C that forms images of cyan color comprises a drum shaped photoreceptor 1C which acts as the first image supporting body, a charging means 2C, an exposing means 3C, a developing means 4C, a primary transfer roller 5C as a primary transfer means, and a cleaning means 6C. The image forming section 10Bk that forms images of black color comprises a drum shaped photoreceptor 1Bk which acts as the first image supporting body, a charging means 2Bk, an exposing means 3Bk, a developing means 4Bk, a primary transfer roller 5Bk as a primary transfer means, and a cleaning means 6Bk.

The abovementioned four sets of image forming units 10Y, 10M, 10C, and 10Bk are constituted, centering on the photosensitive drums 1Y, 1M, 1C, and 1Bk, by the rotating charging means 2Y, 2M, 2C, and 2Bk, the image exposing means 3Y, 3M, 3C, and 3Bk, the rotating developing means 4Y, 4M, 4C, and 4Bk, the primary transfer means 5Y, 5M, 5C, and 5Bk and the cleaning mean 6Y, 6M, 6C, and 6Bk that clean the photosensitive drums 1Y, 1M, 1C, and 1Bk.

The abovementioned image forming units 10Y, 10M, 10C, and 10Bk, all have the same configuration excepting that the color of the toner image formed in each unit is different on the respective photosensitive drums 1Y, 1M, 1C, and 1Bk, and detailed description is given below taking the example of the image forming unit 10Y.

The image forming unit 10Y has, placed around the photosensitive drum 1Y which is the image forming body, a charging means 2Y (hereinafter referred to merely as the charging unit 2Y or the charger 2Y), the exposing means 3Y, the developing means 4Y, and the cleaning means 5Y (hereinafter referred to merely as the cleaning means 5Y or as the cleaning blade 5Y), and forms yellow (Y) colored toner image on the photosensitive drum 1Y. Further, in the present preferred embodiment, at least the photosensitive drum 1Y, the charging means 2Y, the developing means 4Y, and the cleaning means 5Y in this image forming unit 10Y are provided in an integral manner.

The charging means 2Y is a means that applies a uniform electrostatic potential to the photosensitive drum 1Y, and a corona discharge type of charger unit 2Y is being used for the photosensitive drum 1Y in the present preferred embodiment.

The image exposing means 3Y is a means that carries out light exposure, based on the image signal (Yellow), on the photosensitive drum 1Y to which a uniform potential has been applied by the charging means 2Y, and forms the electrostatic latent image corresponding to the yellow color image, and an array of light emitting devices LEDs and imaging elements (product name: selfoc lenses) arranged in the axial direction of the photosensitive drum 1Y or a laser optical system etc., is used as this exposing means 3Y.

In the abovementioned image forming apparatus, structural elements such as the above photoreceptor, the developing device, the cleaning device, and the like may be made in a single body as a process cartridge (image forming unit), and this image forming unit may be structured to be detachably mounted in an apparatus body. Further, at least one of the charging device, the image exposing device, the developing device, the transfer or separating device and the cleaning device is supported together with the photoreceptor as a single body so as to form a process cartridge (image forming unit) and to be made a single image forming unit detachably mounted in the apparatus body, and the process cartridge may be structured to be detachably mounted by the use of a guiding means such as rails of the apparatus body.

The intermediate image transfer body unit 7 in the shape of an endless belt is wound around a plurality of rollers, and has an endless belt shaped intermediate image transfer body 70 which acts as a second image carrying body in the shape of a partially conducting endless belt which is supported in a free to rotate manner.

The images of different colors formed by the image forming units 10Y, 10M, 10C, and 10Bk, are successively transferred on to the rotating endless belt shaped intermediate image transfer body 70 by the primary transfer rollers 5Y, 5M, 5C, and 5Bk acting as the primary image transfer means, thereby forming the synthesized color image. The transfer material P as the transfer material stored inside the sheet feeding cassette 20 (the supporting body that carries the final fixed image: for example, plain paper, transparent sheet, etc.,) is fed from the sheet feeding means 21, pass through a plurality of intermediate rollers 22A, 22B, 22C, and 22D, and the resist roller 23, and is transported to the secondary transfer roller 5*b* which functions as the secondary image transfer means, and the color image is transferred in one operation of secondary image transfer on to the transfer material P. The transfer material P on which the color image has been transferred is subjected to fixing process by the fixing means 24, and is gripped by the sheet discharge rollers 25 and placed above the sheet discharge tray 26 outside the equipment. Here, the transfer supporting body of the toner image formed on the photoreceptor of the intermediate transfer body or of the transfer material, etc. is comprehensively called the transfer media.

On the other hand, after the color image is transferred to the transfer material P by the secondary transfer roller 5*b* functioning as the secondary transfer means, the endless belt shaped intermediate image transfer body 70 from which the transfer material P has been separated due to different radii of curvature is cleaned by the cleaning means 6*b* to remove all residual toner on it.

During image forming, the primary transfer roller 5Bk is at all times pressing against the photoreceptor 1Bk. Other primary transfer rollers 5Y, 5M, and 5C come into pressure contact respectively with their corresponding photoreceptor 1Y, 1M, and 1C only during color image forming.

The secondary transfer roller 5*b* comes into pressure contact with the endless belt shaped intermediate transfer body 70 only when secondary transfer is to be made by passing the transfer material P through this.

Further, the chassis 8 can be pulled out via the supporting rails 82L and 82R from the body A of the apparatus.

The chassis 8 comprises the image forming sections 10Y, 10M, 10C, and 10Bk, and the endless belt shaped intermediate image transfer body unit 7.

The image forming sections 10Y, 10M, 10C, and 10Bk are arranged in column in the vertical direction. The endless belt shaped intermediate image transfer body unit 7 is placed to the left side in the figure of the photosensitive drums 1Y, 1M, 1C, and 1Bk. The endless belt shaped intermediate image transfer body unit 7 comprises the endless belt shaped intermediate image transfer body 70 that can rotate around the rollers 71, 72, 73, and 74, the primary image transfer rollers 5Y, 5M, 5C, and 5Bk, and the cleaning means 6*b*.

Figure 3:
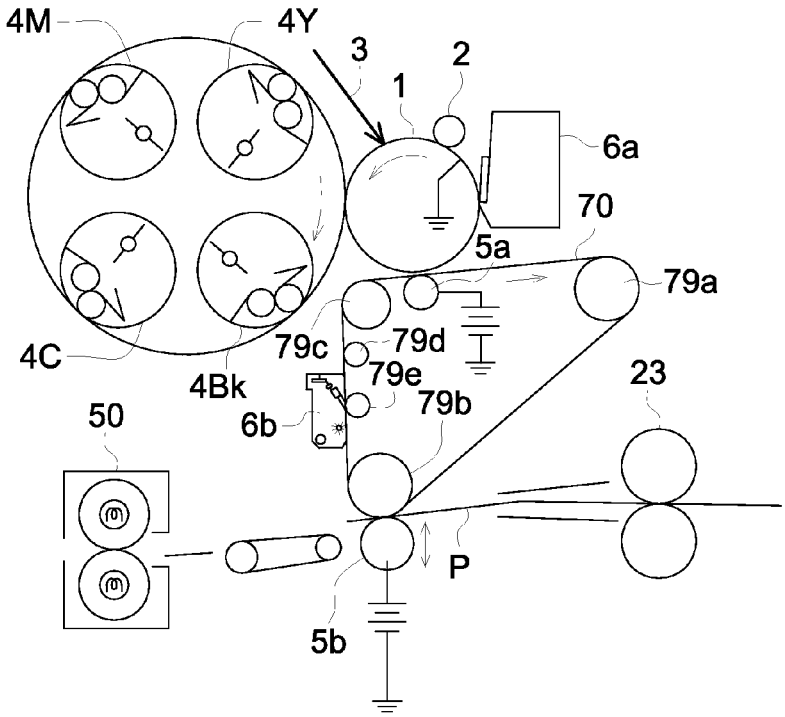
FIG. 3 is a structure cross sectional view of a color image forming apparatus employing an organic photoreceptor of the present invention.

Next, FIG. 3 shows the cross-sectional structural diagram of a color image forming apparatus capable of employing an electrophotographic photoreceptor according to the present invention (a copier or a laser beam printer having at least a charging means, an exposing means, a plurality of developing means, image transfer means, cleaning means, and intermediate image transfer body around the organic photoreceptor). An elastic material with a medium level of electrical resistivity is being used for the belt shaped intermediate image transfer body 70.

In this figure, 1 is a rotating drum type photoreceptor that is used repetitively as the image carrying body, and is driven to rotate with a specific circumferential velocity in the anti-clockwise direction shown by the arrow.

During rotation, the photoreceptor 1 is charged uniformly to a specific polarity and potential by the charging means 2 (charging process), after which it receives from the image exposing means 3 (image exposing process) not shown in the figure image exposure by the scanning exposure light from a laser beam modulated according to the time-serial electrical digital pixel signal of the image information thereby forming the electrostatic latent image corresponding to the yellow (Y) color component image (color information) of the target color image.

Next, this electrostatic latent image is developed by the yellow (Y) developing means: developing process (yellow color developer) 4Y using the yellow toner which is the first color. At this time, the second to the fourth developing means (magenta color developer, cyan color developer, and black color developer) 4M, 4C, and 4Bk are each in the operation switched-off state and do not act on the photoreceptor 1, and the yellow toner image of the above first color does not get affected by the above second to fourth developers.

The intermediate image transfer body 70 is wound over the rollers 79*a*, 79*b*, 79*c*, 79*d*, and 79*e* and is driven to rotate in a clockwise direction with the same circumferential speed as the photoreceptor 1.

The yellow toner image of the first color formed and retained on the photoreceptor 1 is, in the process of passing through the nip section between the photoreceptor 1 and the intermediate image transfer body 70, intermediate transferred (primary transferred) successively to the outer peripheral surface of the intermediate image transfer body 70 due to the electric field formed by the primary transfer bias voltage applied from the primary transfer roller 24*a* to the intermediate image transfer body 70.

The surface of the photoreceptor 1 after it has completed the transfer of the first color yellow toner image to the intermediate image transfer body 70 is cleaned by the cleaning apparatus 6*a*.

In the following, in a manner similar to the above, the second color magenta toner image, the third color cyan toner image, and the fourth color black toner image are transferred successively on to the intermediate image transfer body 70 in a superimposing manner, thereby forming the superimposed color toner image corresponding to the desired color image.

The secondary transfer roller 5*b* is placed so that it is supported by bearings parallel to the secondary transfer opposing roller 79*b* and pushes against the intermediate image transfer body 70 from below in a separable condition.

In order to carry out successive overlapping transfer of the toner images of the first to fourth colors from the photoreceptor 1 to the intermediate image transfer body 70, the primary transfer bias voltage applied has a polarity opposite to that of the toner and is applied from the bias power supply. This applied voltage is, for example, in the range of +100V to +2 kV.

During the primary transfer process of transferring the first to the third color toner image from the photoreceptor 1 to the intermediate image transfer body 70, the secondary transfer roller 5*b* and the intermediate image transfer body cleaning means 6*b* can be separated from the intermediate image transfer body 70.

The transfer of the superimposed color toner image transferred on to the belt shaped intermediate image transfer body on to the transfer material P which is the second image supporting body is done when the secondary transfer roller 5*b* is in contact with the belt of the intermediate image transfer body 70, and the transfer material P is fed from the corresponding sheet feeding resist roller 23 via the transfer sheet guide to the contacting nip between the secondary transfer roller 5*b* and the intermediate image transfer body 70 at a specific timing. The secondary transfer bias voltage is applied from the bias power supply to the secondary image transfer roller 5*b*. Because of this secondary transfer bias voltage, the superimposed color toner image is transferred (secondary transfer) from the intermediate image transfer body 70 to the transfer material P which is the second image supporting body. The transfer material P which has received the transfer of the toner image is guided to the fixing means 50 and is heated and fixed there.

The image forming method according to the present invention can be applied in general to all electro-photographic apparatuses such as electro-photographic copiers, laser printers, LED printers, and liquid crystal shutter type printers, and in addition, it is also possible to apply the present invention to a wide range of apparatuses applying electro-photographic technology, such as displays, recorders, light printing equipment, printing screen production, and facsimile equipment <Toner>

A toner usable in the present invention may be a pulverization toner or a polymerization toner, but a polymerization toner prepared by a polymerization process is preferred as a toner from the viewpoint that a stable particle size distribution can be obtained.

The polymerization toner means a toner in which the formation of binder resin for toner and the shape of toner are formed by polymerization of raw material monomer of binder resin and chemical treatment followed as required. Specifically, it means a toner formed through a polymerization reaction such as suspension polymerization or emulsion polymerization, and fusion process among particles followed as required.

The volume average particle size of a toner, that is, 50% volume particle size (Dv50) is preferably from 2 to 9 m, and more preferably from 3 to 7 μm. This particle size range results in enhanced resolution. Further, the combination with the foregoing range can reduce the content of minute toner particles, leading to improved dot image reproducibility, superior sharpness and stable image formation.

<Developer>

A developer relating to the invention may be a single component developer or two component developer.

A single component developer includes a non-magnetic single component developer and a magnetic single component developer containing 0.1-0.5 μm magnetic particles, each of which is usable.

A toner may be mixed with a carrier, which is usable as a two-component developer. In that case, there are usable commonly known materials, such as metals of iron, ferrite, magnetite or the like and alloys of these metals and a metal of aluminum or lead. Of these, ferrite particles are specifically preferred. The foregoing magnetic particles preferably are those having a volume average particle size of 15 to 100 μm (more preferably, 25 to 80 μm).

The volume average particle size of a carrier can be measured by laser refraction type particle size analyzer, HELOS (produced by SYMPATEC Co.).

A carrier is preferably one which covered with a resin or a resin dispersion type one in which magnetic particles are dispersed in a resin. A resin used for coating is not specifically limited but examples thereof include a olefin rein, styrene resin, styrene-acryl resin, silicone resin, ester resin and fluorine-containing resin. A resin constituting a resin dispersion type carrier is not specifically limited but employs commonly known one, including, for example, styrene-acryl resin, polyester resin, fluororesin, a phenol resin and the like.

EXAMPLE

Hereafter, the present invention will be explained concretely with reference to examples. However, the present invention is not limited to these examples. In the following examples, the term "part" represents part by mass, and the term "%" represents % by mass.

A. Experiment No. 1

With the procedures shown below, "Photoreceptors 1 to 10, and 41" were produced, and below-mentioned evaluation was conducted for the produced photoreceptors.

1. Production of "Photoreceptor 1"

(Production of Support 1)

The surface of a cylindrical aluminum support was subjected to a cutting processing treatment in the following procedures. First, the surface was applied with rough processing by the use of a commercially-available polycrystal diamond-sintered flat cutting tool capable of forming convexo-concave pattern configuration with the adjustments: a cut-in depth of this cutting tool being 0.035 mm, a feed pitch of 0.2 mm/rev and the number of rotations being 6000 rpm. Subsequently, the surface was applied with finish processing by the use of a commercially-available diamond flat cutting tool employing a single crystal diamond. At the time of the finish processing with the diamond flat cutting tool, a setting angle, a push-in depth and the number of rotations were set on the above conditions.

Further, thereafter, the surface was subjected to a jetting treatment with a jetting pressure of 3.92 MPa by the use of a cleaning liquid in which a commercially-available surface active agent formulation "DK Be clear CW5524 (manufactured by Dai-Ichi Kogyo Seiyaku Ca, Ltd.)" was diluted by 10 times. With abovementioned procedures, "Support 1" with the skewness (Rsk) of a profile curve of −0.24 and a 10-point surface roughness Rz of 1.3 μm was produced.

(Formation of Intermediate Layer 1)

On the above "Support 1", an intermediate layer coating liquid was coated by a dip coating method so that Intermediate layer 1 with a dried layer thickness of 5.0 μm was formed. The intermediate layer coating liquid was produced in such a way that an intermediate layer dispersion liquid having the following composition was diluted with isopropyl alcohol by two times, and the diluted liquid was made to stand still over one night, and then was filtered (filter: Lidi-mesh filter, manufactured by Nippon Pole Corporation, nominal filtration accuracy: 5 μm, pressure: 50 kPa).

(Intermediate Layer Dispersion Liquid)

| | |
|---|---|
| Binder resin (polyamide resin N-1 with the following structure) | 1 part |
| N-1 | |
| Anatase type titanium oxide A1 (Primary particle size: 30 nm, subjected to surface treatment with fluoroethyltrimethoxysilne) | 3 parts |
| Isopropyl alcohol | 10 parts |

Anatase type titanium oxide A1 (Primary particle six: 30 nm, subjected to surface treatment with fluoroethyltrimethoxysilne) 3 parts Isopropyl alcohol 10 parts The abovementioned components were mixed, and subjected to dispersing treatment in a batch process for 10 hours by the use of a sand mill dispersing device, whereby the intermediate layer dispersion liquid was produced.

(Formation of a Charge Generating Layer)

The following components were mixed, and dispersed by the use of a sand mill dispersing device, whereby the charge generating layer coating liquid was prepared. This coating liquid was coated by a dip coating method so that the charge generating layer with a dried layer thickness of 0.8 μm was formed was formed on the above "Intermediate layer 1".

| | |
|---|---|
| Hydroxy gallium phthalocyanine pigment (CGM-1: having a peak 7A° and 28.2° on a diffraction angle (20 ± 0.2) in the X ray diffraction spectrum by the Cu-Kα characteristic X ray) | 20 parts |
| Polyvinyl butyral resin (#6000-C, manufactured by DENKI KAGAKU KOGYO Co., Ltd.) | 10 parts |
| Acetic acid t-butyl | 700 parts |
| 4-methoxy-4-methyl-2-pentanone | 300 parts |

(Formation of a Charge Transporting Layer)

The following components were mixed, and dissolved so that the charge transporting layer coating liquid was prepared. This coating liquid was coated by a dip coating method on the charge generating layer so that the charge transporting layer with a dried layer thickness of 24 μm was formed.

With the above procedures, "Photoreceptor 1" was produced.

| | |
|---|---|
| Charge transporting substance (4-methoxy-4'-(4-methyl-beta-phenyl styryl) triphenylamine) | 75 parts |
| Polycarbonate resin "Iupilon Z300" (manufactured by Mitsubishi Gas Chemical Co., Inc.) | 100 parts |
| Antioxidant (the below-mentioned compound A) | 2 parts |
| Tetrahydrofuran/toluene (volume ratio: 7/3) | 750 parts |

Compound A

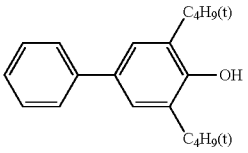

2. Production of "Photoreceptors 2 to 10, 41"

"Photoreceptors 2 to 10, 41" were produced in such a way that the condition of producing a support and the condition of the coating liquid for forming an intermediate layer and the thickness of the intermediate layer which were conducted in the production of "Photoreceptor 1" were changed as indicated in the following items respectively and photoreceptors were produced on the changed condition.

(1) Production of "Photoreceptor 2"

"Photoreceptor 2" was produced in the same way as that in the above "Photoreceptor 1" except that in place of the jetting treatment with the cleaning liquid conducted at the time of producing "Support 1" of the above "Photoreceptor 1", the dry ice blasting treatment with a jetting pressure 0.4 MPa by the use of dry ice particles with 0.3 mm by "Super blast DSC-1 (manufactured by Fuji Manufacturing Co., Ltd.)" was conducted so that "Support 2" was produced and the thickness of the intermediate layer was changed to 6 μm.

(2) Production of "Photoreceptor 3"

"Photoreceptor 3" was produced in the same way as that in the above "Photoreceptor 2" except that the size of dry ice particles used in the dry ice blasting treatment conducted in the production of "Photoreceptor 2" was changed to 1 mm and the jetting pressure was changed to 0.6 MPa.

(3) Production of "Photoreceptor 4"

"Photoreceptor 4" was produced in the same way as that in the above "Photoreceptor 1" except that in place of the jetting treatment with the cleaning liquid conducted at the time of producing "Support 1" of the above "Photoreceptor 1", the following sand blasting treatment was conducted so that "Support 4" was produced. The sand blasting treatment was conducted by the use of alumina ($Al_2O_3$) abrasive grains #5000 (average particle size: 2 μm) with a spraying pressure of 0.294 MPa by "MICROBLASTER MB1 (manufactured by SIINTOBRATOR Co., Ltd.)". Further, the thickness of the intermediate layer was changed into 5 μm.

(4) Production of "Photoreceptor 5 (Comparative Example)"

"Photoreceptor 5" was produced in the same way as that in the above "Photoreceptor 4" except that "Support 5" was produced such that the finish processing by the use of a diamond flat cutting tool employing a single crystal diamond was not conducted in the cutting work at the time of producing "Photoreceptor 4", the abrasive grains used in the sand blasting treatment by "MICROBLASTER MB1 (manufactured by SIINTOBRATOR Co., Ltd.)" were changed to alumina ($Al_2O_3$) abrasive grains #3000 (average particle size: 5 μm), and the spraying pressure was changed to 0.54 MPa, and the thickness of the intermediate layer was changed into 8 μm.

(5) Production of "Photoreceptor 6"

"Photoreceptor 6" was produced in the same way as that in the above "Photoreceptor 1" except that "Support 6" was produced such that the rough processing was conducted by the use of a commercially-available polycrystal diamond-sintered R cutting tool (the radius of nose: 20 mm) in place of the cutting tool used in the cutting work in the production of the above "Photoreceptor 1", and then, the finish processing was conducted by the use of a single crystal diamond R cutting tool (the radius of nose: 20 mm), further, the jetting treatment with the jetting pressure was conducted on the same condition as in the time of producing "Support 1". Further, at the time of forming the intermediate layer, the titanium oxide A1 used in the coating liquid was changed to the rutile type titanium dioxide A2 (subjected to the same surface treatment as the titanium oxide A1) with a primary average particle diameter of 25 nm, and thickness was changed into 3 μm.

(6) Production of "Photoreceptor 7"

"Photoreceptor 7" was produced in the same way as that in the above "Photoreceptor 4" except that "Support 7" was produced in the same procedure except that the cutting tool to be used in the rough processing in the cutting work was changed to a commercially-available polycrystal diamond-sintered R cutting tool (the radius of nose: 20 mm), and the cutting tool to be used in the finish processing was change to a commercially-available single crystal diamond R cutting tool (the radius of nose: 20 mm). Further, at the time of forming the intermediate layer, the titanium oxide A1 used in the coating liquid was changed to the rutile type titanium dioxide A3 (subjected to the same surface treatment as the titanium oxide A1) with a primary average particle diameter of 35 nm, and thickness was changed into 2 μm.

(7) Production of "Photoreceptor 8"

"Photoreceptor 8" was produced in the same way as that in the above "Photoreceptor 4" except that at the time of forming the intermediate layer, the titanium oxide A1 used in the coating liquid was changed to a zinc oxide (primary particle diameter of 155 nm, subjected to a surface treatment with methyl hydrogen siloxane).

(8) Production of "Photoreceptor 9 (Comparative Example)"

"Photoreceptor 9" was produced in the same way as that in the above "Photoreceptor 1" except that "Support 9" was produced without conducting the jetting treatment with the cleaning liquid conducted at the time of producing "Support 1".

(9) Production of "Photoreceptor 10 (Comparative Example)"

"Photoreceptor 10" was produced in the same way as that in the above "Photoreceptor 4" except that the finish processing with the diamond flat cutting tool employing a single crystal diamond used in the cutting work at the time of producing "Support 4" of the above "Photoreceptor 4" was not conducted, further "Support 10" was produced by being subjected to the sand blasting treatment by the use of alumina ($Al_2O_3$) abrasive grains #5000 (average particle size: 2 μm) with a spraying pressure of 0.098 MPa by "MICRO-BLASTER MB1 (manufactured by SIINTOBRATOR Co., Ltd.)".

(10) Production of "Photoreceptor 41 (Comparative Example)"

"Photoreceptor 41" was produced in the same way as that in the above "Photoreceptor 1" except that the hydroxygallium phthalocyanine used at the time of forming the charge generating layer was changed to a non-metal phthalocyanine pigment.

3. Evaluation Test (1) Evaluation Condition

The photoreceptors produced by the abovementioned procedures were mounted on a modified machine of a commercially-available full color compound machine "bizhubPRO C6500 (manufactured by Konica Minolta Business Technologies Inc.)" with a structure shown in FIG. 2 in which a write-in dot diameter was made adjustable. A laser light source with a wavelength of 405 nm was used as an image exposure light source, and was set such that the diameter of an exposure beam, in the main scanning direction, of the write-in light source was made to 30 μm (800 dpi) and the spot exposure with this diameter of exposure beam was made to 0.5 mW on the surface of a photoreceptor. Since the above full color compound machine had 4 sets of image forming units, the evaluation was conducted in such a way that the same kind of photoreceptors was mounted on the respective image forming units (for example, when "photoreceptor 1" was evaluated, four "photoreceptors 1" were mounted on the respective image forming units).

In the evaluation, first, a print endurance test was conducted in such a way that an A-4 size print image with a pixel rate of 7% was printed on 50,000 sheet under the environment of a temperature of 30° C. and a relative humidity of 80% RH, and then another A-4 size print image to be subjected to the following evaluation was printed under the environment of a temperature of 0° C. and a relative humidity of 60% RH. As print images for evaluation, three types of a black-and-white image for evaluation of fog, image defects, a black-and-white image for evaluation of dot image reproducibility and full color halftone image were printed.

(2) Evaluation Items and Evaluation Criterion

<Fog>

As the fog, a reflection density on a solid white image portion of a printed black-and-white image was measured by the use of a reflection density meter "RD-918 (manufactured by Macbeth Corporation)". The reflection density on a non-printed A-4 size sheet was made 0.000 as a reference density, and the measured reflection density was represented as a relative density to the reference density. The measured reflection density (fog) was evaluated based on the following evaluation criterion and classified into one of ranks. In the ranks, "AA" and "A" were deemed as acceptable.

Evaluation Criterion

AA: the reflection density (fog) is less than 0.010 (good).

A: the reflection density is 0.010 or more and 0.020 or less (level at practically no problem).

C: the reflection density is higher than 0.020 (level at practically problematic).

<Reproducibility of Dot Image>

The print image for evaluation of dot image reproducibility was made such that on a white background of a A-4 size sheet, formed are a line image having a width corresponding to a single dot (hereafter, referred to as a one dot line image), a solid black image, and a white line image formed in the solid image and having a width corresponding to two dots (hereafter, referred to as a two dot ling image). Visual evaluation for the reproducibility of the one line dot image formed on the white background, and the density of the solid black image and visual evaluation for the reproducibility of the two dot line image formed on the solid black image were conducted as indicated below. The density of the solid black image was measured by the use of a reflection density meter "RD-918 (manufactured by Macbeth Corporation)", the reflection density on a non-printed A-4 size sheet was made 0.000 as a reference density, and the measured reflection density was represented as a relative density to the reference density. In the following ranks, "AA" and "A" were deemed as acceptable.

Evaluation Criterion (1) Evaluation for the One Dot Line Image and the Density of the Solid Black Image AA: a continuous black dot line image was confirmed, and the density of the solid black image is 1.2 or more (good)

A: a continuous black dot line image was confirmed, and the density of the solid black image is 1.0 or more and less than 1.2 (practically no problem)

C: a cut or discontinuous black dot line image was confirmed, or although a continuous black dot line image was confirmed, the density of the solid black image less than 1.0 (practically problematic)

(2) Evaluation for the Two Dot Line Image and the Density of the Solid Black Image AA: a continuous white dot line image was confirmed, and the density of the solid black image is 1.2 or more (good)

A: a continuous white dot line image was confirmed, and the density of the solid black image is 1.0 or more and less than 1.2 (practically no problem)

C: a cut or discontinuous white dot line image was confirmed, or although a continuous white dot line image was confirmed, the density of the solid black image less than 1.0 (practically problematic)

<Image Defect>

The image defect was evaluated in such a way that on the solid white image portion of the black-and-white image print mentioned above, the number of occurred image defects of visible black spots conforming to the cycle of the photoreceptor and black streaks with a length of 0.4 mm or more was calculated.

Evaluation Criterion

AA: five or less (good)

A: six or more and ten or less (practically no problem)

C: eleven or more (practically problematic)

<Evaluation of Color Image>

The color image evaluation was performed by the use of the full color halftone image print including a photograph of the face of a person. In the full color halftone image print including a photograph of the face of a person, a full color photograph image of the face of a person, and a halftone image of each ff yellow, magenta, cyan and black were outputted on a A4 size sheet. In the evaluation, as described below, the occurrence situation of image defects called unevenness and spots on a full color photograph image of the face of a person and the occurrence situation of interference fringes and streaks-like unevenness on a halftone image were evaluated by visual observation.

Evaluation Criterion

AA: interference fringes and streaks-like unevenness were not observed on all of the halftone images, smooth finish was reproduced, and image defects were not observed on the photograph image of the face of a person (good).

A: interference fringes and streaks-like unevenness were slightly observed on the halftone images, it was judged that smooth finish was reproduced, and image defects were not observed on the photograph image of the face of a person (practically no problem).

C: there were halftone images in which interference fringes and streaks-like unevenness were appreciably observed, it was not judged that smooth finish was reproduced, and image defects occurred on the photograph image of the face of a person (practically problematic).

<Adhesive Property>

The evaluation of the adhesive property on the interface between the photosensitive layer and the intermediate layer in the above "Photoreceptors 1 to 10, and 41" was performed by the grid tape method based on JISK 5400. That is, the coating surface of a photoreceptor and the tape were observed so as to obtain the number of grids peeled off on the interface between the photosensitive layer and the intermediate layer, whereby the ratio of the peeled area was calculated. In the adhesive property test by the grid tape method, 100 grids were formed on each of the abovementioned photoreceptors on with a tape, the grid test was conducted with the procedure described in the above JIS, and the number of remaining grids among 100 grids was counted and evaluated.

Evaluation Criterion

AA: the number of remaining grids was 80% or more (good).

A: the number of remaining grids was 50% or more and less than 80% (practically no problem).

C: the number of remaining grids was less than 50% (improper).

The results of the above are shown in Table 1.

In Table 1, A1 shown in the column of the grain kind in the item of the intermediate layer represents an anatase type titanium oxide, A2 and A3 represents a rutile type titanium dioxide, and Z represents a zinc oxide.

TABLE 1

| | Conductive support | | Intermediate layer | | | | | Dot image reproducibility | | | | | |
|---|---|---|---|---|---|---|---|---|---|---|---|---|---|
| Photoreceptor No. | Rsk | Rz (μm) | Particle kind | Particle size (μm) | Film thickness (μm) | Charge generating layer | Fog | Single dot line | Two dot line | Image defects | Color image evaluation | Adhesive properties | Remarks |
| Photoreceptor 1 | −0.24 | 1.3 | A1 | 30 | 5 | CGM-1 | A | AA | AA | AA | AA | A | Inventive |
| Photoreceptor 2 | −1.36 | 1.1 | A1 | 30 | 6 | CGM-1 | AA | AA | AA | AA | AA | AA | Inventive |
| Photoreceptor 3 | −3.21 | 1.0 | A1 | 30 | 6 | CGM-1 | AA | AA | AA | AA | AA | AA | Inventive |
| Photoreceptor 4 | −7.84 | 0.8 | A1 | 30 | 5 | CGM-1 | AA | AA | A | A | A | AA | Inventive |
| Photoreceptor 5 | −9.78 | 0.7 | A1 | 30 | 8 | CGM-1 | A | A | A | A | C | AA | Comparative |
| Photoreceptor 6 | −0.38 | 0.3 | A2 | 25 | 3 | CGM-1 | A | A | A | AA | A | A | Inventive |
| Photoreceptor 7 | −0.74 | 1.8 | A3 | 35 | 2 | CGM-1 | A | A | A | AA | AA | AA | Inventive |
| Photoreceptor 8 | −7.84 | 0.8 | Z | 155 | 5 | CGM-1 | AA | A | A | A | A | AA | Inventive |
| Photoreceptor 9 | 1.42 | 1.3 | A1 | 30 | 5 | CGM-1 | A | C | A | C | A | C | Comparative |
| Photoreceptor 10 | 0.18 | 1.3 | A1 | 30 | 5 | CGM-1 | A | C | A | A | A | A | Comparative |
| Photoreceptor 41 | −0.24 | 1.3 | A1 | 30 | 5 | Non metal phthalo-cyanine | C | C | A | A | C | A | Comparative |

*CGM-1: hydroxygallium phthalocyanine pigment

As shown in Table 1, "Photoreceptors 1 to 4, 6 to 8" which had a skewness (Rsk) of a profile curve of the conductive support being within the range specified by the present invention and the structure that a metal phthalocyanine pigment was contained in a charge generating layer, resulted to obtain good results in terms of each evaluation item. On the other hand, "Photoreceptors 5, 9, 10" which had a skewness (Rsk) of a profile curve of the conductive support being out of the range specified by the present invention and "Photoreceptors 41" in which a non-metal phthalocyanine pigment was contained in the charge generating layer, resulted in that any one of evaluation items was judged as being practically problematic.

B. Experiment No. 2

"Photoreceptors 11 to 40" were produced such that the charge generating material used at the time of forming the charge generating layer and the charge transporting material used at the time of forming the charge transporting layer were changed as shown in below.

1. Production of "Photoreceptors 11 to 20"

The "hydroxy gallium phthalocyanine pigment" used at the time of forming a charge generating layer in the production of the above "Photoreceptors 1 to 10" was changed to "chloro gallium phthalocyanine pigment". In Table 2 described later, "chloro gallium phthalocyanine pigment" is represented as "GCM-2". The "chloro gallium phthalocyanine pigment" was confirmed to have a peak at 7.4°, 16.6°, 25.5° and 28.3° on a diffraction angle (2θ≅0.2) in the measurement of the X ray diffraction spectrum by the Cu-Kα characteristic X ray. Further, "4-methoxy-4'-(4-methyl-β-phenyl styryl)triphenylamine" used at the time of forming the charge transporting layer was changed to "N,N'-diphenyl-N,N-bis(3-methyl-phenyl)-[1,1']biphenyl-4,4'-diamine".

Except the above, "Photoreceptors 11 to 20" were produced in the same way as that in "Photoreceptors 1 to 10".

2. Production of "Photoreceptors 21 to 30"

The "hydroxy gallium phthalocyanine pigment" used at the time of forming a charge generating layer in the production of the above "Photoreceptors 1 to 10" was changed to "Y-type oxy titanyl phthalocyanine pigment". In Table 3 described later, "Y-type oxy titanyl phthalocyanine pigment" is represented as "GCM-3". The "Y-type oxy titanyl phthalocyanine pigment" was confirmed to have a peak at 27.3° on a diffraction angle (2θ±0.2) in the measurement of the X ray diffraction spectrum by the Cu-Kα characteristic X ray. Except the above, "Photoreceptors 21 to 30" were produced in the same way as that in "Photoreceptors 1 to 10".

3. Production of "Photoreceptors 31 to 40"

The "hydroxy gallium phthalocyanine pigment" used at the time of forming a charge generating layer in the production of the above "Photoreceptors 1 to 10" was changed to "azo CGM-1 pigment" or "azo CGM-2 pigment" mentioned above. Further, "4-methoxy-4'-(4-methyl-β-phenyl styryl)triphenylamine" used at the time of forming the charge transporting layer was changed to "CTM-3" with the below-mentioned structure. Except the above, "Photoreceptors 31 to 40" were produced in the same way as that in "Photoreceptors 1 to 10".

CTM-3

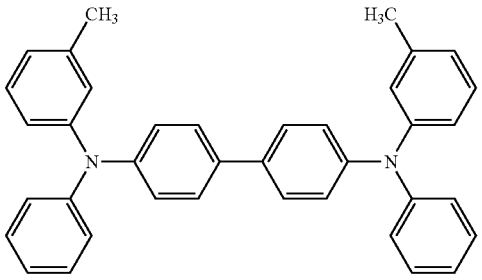

4. Evaluation Test

As same as the above-mentioned "Photoreceptors 1 to 10, and 41", the above "Photoreceptors 11 to 20", "Photoreceptors 21 to 30", and "Photoreceptors 31-40" were mounted on the abovementioned image forming apparatus and the above-mentioned evaluation was conducted. The results in "Photoreceptors 11 to 20" are shown in Table 2, the results in "Photoreceptors 21 to 30" are shown in Table 3, and the results in "Photoreceptors 31 to 40" are shown in Table 4.

TABLE 2

| | Conductive support | | Intermediate layer | | | | | Dot image reproducibility | | | | | |
|---|---|---|---|---|---|---|---|---|---|---|---|---|---|
| Photoreceptor No. | Rsk | Rz (μm) | Particle kind | Particle size (μm) | Film thickness (μm) | Charge generating layer | Fog | Single dot line | Two dot line | Image defects | Color image evaluation | Adhesive properties | Remarks |
| Photoreceptor 11 | −0.24 | 1.3 | A1 | 30 | 5 | CGM-2 | A | AA | AA | AA | AA | A | Inventive |
| Photoreceptor 12 | −1.36 | 1.1 | A1 | 30 | 6 | CGM-2 | AA | AA | AA | AA | AA | AA | Inventive |
| Photoreceptor 13 | −3.21 | 1.0 | A1 | 30 | 6 | CGM-2 | AA | AA | AA | AA | AA | AA | Inventive |
| Photoreceptor 14 | −7.84 | 0.8 | A1 | 30 | 5 | CGM-2 | AA | AA | AA | A | A | AA | Inventive |
| Photoreceptor 15 | −9.78 | 0.7 | A1 | 30 | 8 | CGM-2 | A | A | A | A | C | AA | Comparative |
| Photoreceptor 16 | −0.38 | 0.3 | A2 | 25 | 3 | CGM-2 | A | A | A | AA | A | A | Inventive |
| Photoreceptor 17 | −0.74 | 1.8 | A3 | 35 | 2 | CGM-2 | A | A | A | AA | AA | AA | Inventive |
| Photoreceptor 18 | −7.84 | 0.8 | Z | 155 | 5 | CGM-2 | AA | A | A | A | A | AA | Inventive |
| Photoreceptor 19 | 1.42 | 1.3 | A1 | 30 | 5 | CGM-2 | A | C | A | C | A | C | Comparative |
| Photoreceptor 20 | 0.18 | 1.3 | A1 | 30 | 5 | CGM-2 | A | C | A | A | A | A | Comparative |

*CGM-2: chloro gallium phthalocyanine pigment

TABLE 3

| | Conductive support | | Intermediate layer | | | | | Dot image reproducibility | | | | | |
|---|---|---|---|---|---|---|---|---|---|---|---|---|---|
| Photoreceptor No. | Rsk | Rz (μm) | Particle kind | Particle size (μm) | Film thickness (μm) | Charge generating layer | Fog | Single dot line | Two dot line | Image defects | Color image evaluation | Adhesive properties | Remarks |
| Photoreceptor 21 | −0.24 | 1.3 | A1 | 30 | 5 | CGM-3 | A | AA | AA | AA | AA | A | Inventive |
| Photoreceptor 22 | −1.36 | 1.1 | A1 | 30 | 6 | CGM-3 | AA | AA | AA | AA | AA | AA | Inventive |
| Photoreceptor 23 | −3.21 | 1.0 | A1 | 30 | 6 | CGM-3 | AA | AA | AA | AA | AA | AA | Inventive |
| Photoreceptor 24 | −7.84 | 0.8 | A1 | 30 | 5 | CGM-3 | AA | AA | AA | A | A | AA | Inventive |
| Photoreceptor 25 | −9.78 | 0.7 | A1 | 30 | 8 | CGM-3 | A | A | A | A | C | AA | Comparative |
| Photoreceptor 26 | −0.38 | 0.3 | A2 | 25 | 3 | CGM-3 | A | A | A | AA | A | A | Inventive |
| Photoreceptor 27 | −0.74 | 1.8 | A3 | 35 | 2 | CGM-3 | A | A | A | AA | AA | AA | Inventive |
| Photoreceptor 28 | −7.84 | 0.8 | Z | 155 | 5 | CGM-3 | AA | A | A | A | A | AA | Inventive |
| Photoreceptor 29 | 1.42 | 1.3 | A1 | 30 | 5 | CGM-3 | A | C | A | C | A | C | Comparative |
| Photoreceptor 30 | 0.18 | 1.3 | A1 | 30 | 5 | CGM-3 | A | C | A | A | A | A | Comparative |

*CGM-3: Y-type oxy titanyl phthalocyanine pigment

TABLE 4

| Photoreceptor No. | Conductive support Rsk | Rz (μm) | Intermediate layer Particle kind | Particle size (μm) | Film thickness (μm) | Charge generating layer | Fog | Dot image reproducibility Single dot line | Two dot line | Image defects | Color image evaluation | Adhesive properties | Remarks |
|---|---|---|---|---|---|---|---|---|---|---|---|---|---|
| Photoreceptor 31 | −0.24 | 1.3 | A1 | 30 | 5 | Azo CGM-1 | A | AA | AA | AA | AA | A | Inventive |
| Photoreceptor 32 | −1.36 | 1.1 | A1 | 30 | 6 | Azo CGM-1 | AA | AA | AA | AA | AA | AA | Inventive |
| Photoreceptor 33 | −3.21 | 1.0 | A1 | 30 | 6 | Azo CGM-1 | AA | AA | AA | AA | AA | AA | Inventive |
| Photoreceptor 34 | −7.84 | 0.8 | A1 | 30 | 5 | Azo CGM-1 | AA | AA | AA | A | A | AA | Inventive |
| Photoreceptor 35 | −9.78 | 0.7 | A1 | 30 | 8 | Azo CGM-1 | A | A | A | A | C | AA | Comparative |
| Photoreceptor 36 | −0.38 | 0.3 | A2 | 25 | 3 | Azo CGM-2 | A | A | A | AA | A | A | Inventive |
| Photoreceptor 37 | −0.74 | 1.8 | A3 | 35 | 2 | Azo CGM-2 | A | A | A | AA | AA | AA | Inventive |
| Photoreceptor 38 | −7.84 | 0.8 | Z | 155 | 5 | Azo CGM-2 | AA | A | A | A | A | AA | Inventive |
| Photoreceptor 39 | 1.42 | 1.3 | A1 | 30 | 5 | Azo CGM-2 | A | C | A | C | A | C | Comparative |
| Photoreceptor 40 | 0.18 | 1.3 | A1 | 30 | 5 | Azo CGM-2 | A | C | A | A | A | A | Comparative |

As shown in Table 2 and Table 3, "Photoreceptors 11 to 14, 16 to 18" and "Photoreceptors 21 to 24, 26 to 28" which had the structure of the present invention obtained good result in terms of each evaluation item. On the other hand, "Photoreceptors 15, 19, 20" and "Photoreceptors 25, 29, 30" which had a skewness (Rsk) of a profile curve of the conductive support being out of the range specified by the present invention, resulted in that any one of evaluation items was judged as being practically problematic.

Further, as shown in Table 4, "Photoreceptors 31 to 34, 36 to 38" which had a value of the skewness of a conductive support being within the range specified by the present invention, resulted to obtain good results in each evaluation item.

C. Experiment No. 3

"Photoreceptors 1 to 10, and 41" were evaluated in the same way as in Experiment No. 1 except that the setting was changed such that the diameter of an exposure beam, in the main scanning direction, of the writing light source was changed to 10 μm (2400 dpi) and the spot exposure beam with this diameter of exposure beam was changed to become 0.5 mW on the surface of a photoreceptor. As a result, although the density of the single dot line image and the solid black image showed the tendency to lower as a whole as compared with Experiment No. 1, any one of the photoreceptors having the structure of the present invention was evaluated as being practically no problem. Further, in terms of other evaluation items, any one of the photoreceptors resulted to obtain almost the same results as Experiment No. 1.

Moreover, "Photoreceptors 11 to 20" and "Photoreceptors 21 to 30" were also subjected to the evaluation on the above exposing condition. As a result, although the density of the single dot line image and the solid black image showed the same tendency as the above, any one of the photoreceptors having the structure of the present invention was evaluated as being practically no problem. Further, in terms of other evaluation items, any one of the photoreceptors resulted to obtain almost the same results as Experiment No. 2.

D. Experiment No. 4

"Photoreceptors 1 to 10 and 41" were evaluated in the same way as in Experiment No. 1 except that the setting was changed such that the diameter of an exposure beam, in the main scanning direction, of the writing light source was changed to 50 μm (480 dpi) and the spot exposure beam with this diameter of exposure beam was changed to become 0.5 mW on the surface of a photoreceptor. As a result, any one of the photoreceptors having the structure of the present invention resulted to obtain almost the same results as Experiment No. 1. Further, "Photoreceptors 11 to 20" and "Photoreceptors 21 to 30" were also subjected to the evaluation on the above exposing condition. As a result, any one of the photoreceptors having the structure of the present invention resulted to obtain almost the same results as Experiment No. 2.

E. Experiment No. 5

"Photoreceptors 1 to 10 and 41" were evaluated in the same way as in Experiment No. 1 except that the image exposure light source was changed from the 405 nm short wavelength laser light source to a 405 nm light emitting diode. As a result, any one of the photoreceptors having the structure of the present invention resulted to obtain almost the same results as shown in Table 1. Further, "Photoreceptors 11 to 20" and "Photoreceptors 21 to 30" were also subjected to the evaluation by the use of the 405 nm light emitting diode. As a result, any one of the photoreceptors having the structure of the present invention resulted to obtain almost the same results as Experiment No. 2.

F. Experiment No. 6

"Photoreceptors 1 to 10 and 41" were evaluated in the same way as in Experiment No. 3 except that the image exposure light source was changed from the 405 nm short wavelength laser light source to a 405 nm light emitting diode. As a result, as with Experiment No. 3, although the density of the single dot line image and the solid black image showed the same tendency as the above, any one of the photoreceptors having the structure of the present invention was evaluated as being practically no problem. Further, in terms of other evaluation items, any one of the photoreceptors resulted to obtain almost the same results as Experiment No. 3.

Moreover, "Photoreceptors 11 to 20" and "Photoreceptors 21 to 30" were also subjected to the evaluation on the above exposing condition. As a result, although the density of the single dot line image and the solid black image showed the same tendency as the above, any one of the photoreceptors having the structure of the present invention was evaluated as being practically no problem. Further, in terms of other evaluation items, any one of the photoreceptors resulted to obtain almost the same results as Experiment No. 3.

G. Experiment No. 7

"Photoreceptors 1 to 10 and 41" were evaluated in the same way as in Experiment No. 4 except that the image exposure light source was changed from the 405 nm short wavelength laser light source to a 405 nm light emitting diode. As a result, any one of the photoreceptors having the structure of the present invention resulted to obtain almost the same results as shown in Experiment No. 4. Further, "Photoreceptors 11 to 20" and "Photoreceptors 21 to 30" were also subjected to the evaluation with the above exposing condition. As a result, any one of the photoreceptors having the structure of the present invention resulted to obtain almost the same results as Experiment No. 4.

H. Experiment No. 8

"Photoreceptors 1 to 10 and 41" were evaluated in the same way as in Experiment No. 1 except that the image exposure light source was changed from the 405 nm short wavelength laser light source to a 350 nm short wavelength laser light source and the setting was changed such that the diameter of an exposure beam, in the main scanning direction, of the writing light source was changed to 10 μm (2400 dpi) and the spot exposure beam with this diameter of exposure beam was changed to become 0.5 mW on the surface of a photoreceptor. As a result, even with the diameter of an exposure beam being 10 μm, any one of the photoreceptors having the structure of the present invention resulted to obtain the density of the single dot line image and the solid black image with the same level as Experiment No. 1. Further, in terms of other evaluation items, any one of the photoreceptors resulted to obtain almost the same results as Experiment No. 1.

Moreover, "Photoreceptors 11 to 20" and "Photoreceptors 21 to 30" were also subjected to the evaluation on the above exposing condition. As a result, even with the diameter of an exposure beam being 10 μm, any one of the photoreceptors having the structure of the present invention resulted to obtain the density of the single dot line image and the solid black image with the same level as Experiment No. 2. Further, in terms of other evaluation items, any one of the photoreceptors resulted to obtain almost the same results as Experiment No. 2.

I. Experiment No. 9

"Photoreceptors 1 to 10 and 41" were evaluated in the same way as in Experiment No. 1 except that the image exposure light source was changed from the 405 nm short wavelength laser light source to a 500 nm laser light source. As a result, any one of the photoreceptors having the structure of the present invention resulted to obtain the density of the single dot line image and the solid black image with the same level as Experiment No. 1. Moreover, "Photoreceptors 11 to 20" and "Photoreceptors 21 to 30" were also subjected to the evaluation on the above exposing condition. As a result, any one of the photoreceptors having the structure of the present invention resulted to obtain the density of the single dot line image and the solid black image with the same level as Experiment No. 2.

EXPLANATION OF REFERENCE SYMBOLS

| | |
|---|---|
| 10Y, 10M, 10C, and 10Bk | Image formation unit |
| 1 (1Y, 1M, 1C, 1Bk) | Photoreceptor (conductive support) |
| 2 (2Y, 2M, 2C, 2Bk) | Electrically charging means |
| 3 (3Y, 3M, 3C, 3Bk) | Exposing means |
| 4 (4Y, 4M, 4C, 4Bk) | Developing means |
| M | Center in the width direction on the surface of the photosensitive layer of a conductive support |
| P and Q | End portions in the width direction on the surface of the photosensitive layer of a conductive support |
| R and U | Middle points between the center and the end portions |

The invention claimed is:

1. An electrophotographic photoreceptor, comprising:

a cylindrical conductive support; and an intermediate layer, a charge generating layer and a charge transporting layer on the conductive support, wherein the conductive support has a surface on which a repeated convexo-concave configuration with periodicity is formed by a cutting process so that the conductive support has a skewness (Rsk) of a profile curve of the surface which is in a range of $-4<Rsk<-1$, and the charge generating layer contains a metal phthalocyanine pigment.

2. The electrophotographic photoreceptor described in claim 1, wherein the metal phthalocyanine pigment is a gallium phthalocyanine pigment or a titanyl phthalocyanine pigment.

3. The electrophotographic photoreceptor described in claim 2, wherein the gallium phthalocyanine pigment is a hydroxy gallium phthalocyanine pigment which has a peak at least at 7.4° and 28.2° on a diffraction angle (2θ±0.2) in an X-ray diffraction spectrum by X rays with Cu-Kα characteristic.

4. The electrophotographic photoreceptor described in claim 2, wherein the gallium phthalocyanine pigment is a chloro gallium phthalocyanine pigment which has a peak at least at 7.4°, 16.6°, 25.5° and 28.3° on a diffraction angle (2θ±0.2) in an X-ray diffraction spectrum by X rays with Cu-Kα characteristic.

5. The electrophotographic photoreceptor described in claim 2, wherein the gallium phthalocyanine pigment is a gallium phthalocyanine pigment which has a peak at least at 6.8°, 12.8°, 15.8° and 26.6° on a diffraction angle (2θ±0.2) in an X-ray diffraction spectrum by X rays with Cu-Kα characteristic.

6. The electrophotographic photoreceptor described in claim 2, wherein the titanyl phthalocyanine pigment is a Y-type oxy titanyl phthalocyanine pigment which has a peak at least at 27.3° on a diffraction angle (2θ±0.2) in an X-ray diffraction spectrum by X rays with Cu-Kα characteristic.

7. The electrophotographic photoreceptor described in claim 1, wherein the intermediate layer contains N type semiconductive particles.

8. The electrophotographic photoreceptor described in claim 7, wherein the N type semiconductive particles are a titanium oxide or a zinc oxide.

9. The electrophotographic photoreceptor described in claim 8, wherein the titanium oxide is a rutile type titanium oxide or an anatase-type titanium oxide.

10. An image forming method, comprising:

a charging process to provide an electric charge potential on the electrophotographic photoreceptor described in claim 1;

an exposing process to expose the electrophotographic photoreceptor provided with the electric charge potential with an exposure beam having a wavelength light of 350 nm or more and 500 nm or less onto so as to form an electrostatic latent image;

a developing process to supply toner onto the electrophotographic photoreceptor so as to visualize the electrostatic latent image into a toner image; and a transferring process to transfer the above toner image formed on the abovementioned electrophotographic photoreceptor to a transfer medium.

11. The image forming method described in claim 10, wherein an exposure beam source used in the exposing process emits an exposure beam having a diameter of 10 μm or more and 50 μm or less in a main scanning direction.

12. An image forming apparatus, comprising:

the electrophotographic photoreceptor described in claim 1;

a charging device to provide an electric charge potential on the electrophotographic photoreceptor; and an exposing device to expose the electrophotographic photoreceptor provided with the charge potential with an exposure beam having a wavelength light of 350 nm or more and 500 nm or less.

* * * * *